US007504768B2

(12) United States Patent
Oh

(10) Patent No.: US 7,504,768 B2
(45) Date of Patent: Mar. 17, 2009

(54) FIELD EMISSION DISPLAY (FED) AND METHOD OF MANUFACTURE THEREOF

(75) Inventor: Tae-Sik Oh, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 608 days.

(21) Appl. No.: 11/131,413

(22) Filed: May 18, 2005

(65) Prior Publication Data

US 2005/0258738 A1 Nov. 24, 2005

(30) Foreign Application Priority Data

May 22, 2004 (KR) ..... 10-2004-0036672

(51) Int. Cl.
*H01J 1/62* (2006.01)
*H01J 9/00* (2006.01)

(52) U.S. Cl. ..... 313/497; 313/308; 313/309; 313/351; 445/24

(58) Field of Classification Search ..... 313/495–497, 313/306, 309–311, 351, 346 R, 336
See application file for complete search history.

(56) References Cited

U.S. PATENT DOCUMENTS 4,663,559 A * 5/1987 Christensen ..... 313/336
5,552,659 A 9/1996 Macaulay et al.
5,990,614 A * 11/1999 Spindt ..... 313/495
6,922,014 B2 * 7/2005 Oh et al. ..... 313/495
6,972,513 B2 * 12/2005 Shiratori et al. ..... 313/309
7,102,278 B2 * 9/2006 Oh et al. ..... 313/495
2004/0004429 A1 * 1/2004 Oh et al. ..... 313/495
2004/0169151 A1 * 9/2004 Yagi et al. ..... 250/492.2
2005/0067937 A1 * 3/2005 Sheu et al. ..... 313/309
2005/0116612 A1 * 6/2005 Oh ..... 313/497
2005/0258738 A1 * 11/2005 Oh ..... 313/496
2005/0264170 A1 * 12/2005 Oh ..... 313/497
2006/0214559 A1 * 9/2006 Oh ..... 313/496

FOREIGN PATENT DOCUMENTS

JP 2000-348602 12/2000
JP 2003-016907 1/2003
JP 2003-016910 1/2003

OTHER PUBLICATIONS

U.S. Appl. No. 11/131,282, filed May 2005, Tae-Sik Oh.

* cited by examiner

*Primary Examiner*—Peter Macchiarolo
(74) *Attorney, Agent, or Firm*—Robert E. Bushnell, Esq.

(57) ABSTRACT

A Field Emission Display (FED) includes: a first substrate; a cathode arranged on the first substrate: a conductive layer arranged on the cathode, the conductive layer including a first opening; an insulating layer arranged on the first substrate to cover an upper surface and side surfaces of the conductive layer, the insulating layer including a second opening arranged in the first opening to expose a portion of the cathode; a gate electrode arranged on the insulating layer, the gate electrode including a third opening connected to the second opening; a plurality of emitters arranged on the portion of the cathode exposed in the second opening and along both edges of the second opening, the plurality of emitters being spaced apart from each other; and a second substrate facing the first substrate and spaced apart from the first substrate, the second substrate including an anode and a fluorescent layer formed on a surface thereof.

42 Claims, 18 Drawing Sheets

FIELD EMISSION DISPLAY (FED) AND METHOD OF MANUFACTURE THEREOF

CLAIM OF PRIORITY

This application makes reference to, incorporates the same herein, and claims all benefits accruing under 35 U.S.C. §119 from an application for FIELD EMISSION DISPLAY AND METHOD OF MANUFACTURING THE SAME earlier filed in the Korean Intellectual Property Office on May 22, 2004 and thereby duly assigned Serial No. 10-2004-0036672.

CROSS-REFERENCE TO RELATED APPLICATIONS

Furthermore, the present application is related to a co-pending U.S. applications, Ser. No. 11/131,282, entitled FIELD EMISSION DISPLAY AND METHOD OF MANUFACTURING THE SAME, based upon Korean Patent Application Serial No. 10-2004-0036672 filed in the Korean Intellectual Property Office on May 22, 2004, and filed in the U.S. Patent & Trademark Office concurrently with the present application.

BACKGROUND OF THE INVENTION

1. Field of the Invention

The present invention relates to a Field Emission Display (FED) having an electron emitting structure which improves electron beam focusing and prevents a decrease in current density, and a method of manufacture thereof.

2. Description of the Related Art

An image display is typically used as a monitor for a Personal Computer (PC) or a television receiver. The image display can be a Cathode Ray Tube (CRT), a flat panel display such as a Liquid Crystal Display (LCD), a Plasma Display Panel (PDP), and a Field Emission Display (FED).

In the FED, electrons are emitted from an emitter regularly arranged on a cathode by supplying a strong electric field to the emitter from a gate electrode and collide with a fluorescent material coated on a surface of an anode, thereby emitting light. Since the FED forms an image by using a cool cathode electron as an electron emitting source, the image quality is highly affected by the material and structure of the emitter.

A Spindt-type metal tip (or micro tip), which is mainly composed of molybdenum, has been used as the emitter in early FEDs.

In the FED having the metal tip emitter, an ultrafine hole must be formed in order to place the emitter and molybdenum has to be deposited to form a uniform metal micro tip in the entire area of a picture plane. Thus, the manufacturing process is complicated and expensive equipment has to be used, thereby increasing the production costs of the FED. Accordingly, an FED having the metal tip emitter cannot be used for large screens.

Thus, a technique for forming a flat emitter is being studied to obtain good electron emission even with a low voltage drive and to simplify the manufacturing process.

Recently, carbon-based materials, for example, graphite, diamond, Diamond Like Carbon (DLC), $C_{60}$ (Fullerene), and Carbon Nano-Tubes (CNTs) have been used for the flat emitter. Of the above materials, CNT can actively cause electron emission even at a relatively low drive voltage.

A FED having a triode structure includes a cathode, an anode, and a gate electrode. The cathode and the gate electrode are formed on a rear substrate and the anode is formed on a lower surface of a front substrate. Fluorescent layers, composed of R, G, and B phosphors, and a black matrix for improving contrast are formed on the lower surface of the anode. The rear substrate and the front substrate are spaced from each other by a spacer disposed therebetween. In such an FED, the cathode is first formed on the rear substrate, an insulating layer and the gate electrode which have fine openings are stacked thereon, and then emitters are disposed on the cathode located in the openings.

However, the FED having the triode structure as described above has low color purity during driving and has difficulty in obtaining a clear image. These problems occur because most electrons are emitted from an edge portion of the emitter and an electron beam proceeding toward the fluorescent layer diverges due to the voltage (a positive voltage of several volts through tens of volts) supplied to the gate electrode, thereby allowing a phosphor of adjacent other pixel as well as a phosphor of the intended pixel to emit light.

To resolve the above problems, an effort has been made to restrict the electron beam from the emitter from diverging by reducing the area of the emitter corresponding to one pixel to dispose a number of emitters. However, it is difficult to form a number of emitters in a pixel of a predetermined size and the entire area of the emitters for allowing a phosphor of the concerned pixel to emit light decreases. Also, the effect of focusing the electron beam is not sufficient.

In order to prevent the electron beam from diverging, a FED in which a separate electrode for focusing the electron beam is disposed around the gate electrode has been proposed.

An FED in which an electron beam is focused by disposing a ring shaped focusing electrode around the gate electrode or an FED in which an electron beam is focused by using a dual gate composed of a lower gate electrode and an upper gate electrode can be used. However, these FEDs have complicated structures. Also, since the above structures have been mainly applied to a FED having a metal tip emitter formed on the cathode, when the structures are applied to an FED having flat shape emitter, a satisfactory effect has not yet been obtained.

U.S. Pat. No. 5,552,659 relates to an electron emitting structure capable of reducing the divergence of the electron beam by defining thicknesses of a non-insulating layer and a dielectric layer which are formed on a substrate on which an emitter is disposed. However, a number of holes with respect to one pixel are formed and a fine structure composed of a number of electron emitting sources is formed in the respective hole. Thus, the structure is very complicated so that manufacturing is difficult and the structure is also spatially limited. Accordingly, there is a limitation in maximizing the number and the area of the emitter with respect to one pixel, thereby shortening the lifetime.

Also, Japanese Laid-Open Patent Publication Nos. 2000-348602, 2003-16907, and 2003-16910 relate an electron emitting structure having a flat emitter. The electron emitting structure can focus an electron beam by altering the shape of a cathode. However, the density of an electric current emitted from the emitter generally decreases, and thus, a driving voltage increases.

SUMMARY OF THE INVENTION

The present invention provides a Field Emission Display (FED) having an electron emitting structure which improves electron beam focusing and prevents a decrease in current density, and a method of manufacture thereof.

According to one aspect of the present invention, a Field Emission Display (FED) is provided comprising: a first substrate; a cathode arranged on the first substrate: a conductive layer arranged on the cathode, the conductive layer including a first opening; an insulating layer arranged on the first substrate to cover an upper surface and side surfaces of the conductive layer, the insulating layer including a second opening arranged in the first opening to expose a portion of the cathode; a gate electrode arranged on the insulating layer, the gate electrode including a third opening connected to the second opening; a plurality of emitters arranged on the portion of the cathode exposed in the second opening and along both edges of the second opening, the plurality of emitters being spaced apart from each other; and a second substrate facing the first substrate and spaced apart from the first substrate, the second substrate including an anode and a fluorescent layer formed on a surface thereof.

The cathode preferably includes a cavity exposing the first substrate, the cavity being arranged between the plurality of emitters.

The first, second, and third openings and the cavity are preferably square.

A width of the first opening is preferably greater than that of the second opening and a width of the cavity is preferably less than that of the second opening.

A distance between the plurality of emitters is preferably less than the width of the second opening and is preferably greater than the width of the cavity.

A width of the third opening is preferably equal to that of the second opening.

A width of the third opening is alternatively preferably greater than that of the second opening.

The conductive layer preferably extends in a direction of a length of the cathode along both edges of the cathode and the first opening is preferably arranged between the conductive layer on both edges of the cathode.

The conductive layer is preferably arranged on both edges of the cathode and the first opening is preferably arranged between the conductive layer on both edges of the cathode.

The conductive layer is preferably arranged on the cathode to surround the first opening.

At least one of the plurality of emitters preferably contacts a side surface of the insulating layer.

The plurality of emitters preferably comprise a carbon based material.

The plurality of emitters preferably comprise Carbon Nano-Tubes (CNTs).

A plurality of the first, second, and third openings are preferably arranged with respect to one pixel and at least one of the plurality of emitters is preferably arranged in each of the plurality of second openings.

According to another aspect of the present invention, a Field Emission Display (FED) is provided comprising: a first substrate; a cathode arranged on the first substrate: a conductive layer arranged on the cathode, the conductive layer including a first circular opening; an insulating layer arranged on the first substrate to cover an upper surface and side surfaces of the conductive layer, the insulating layer including a second circular opening arranged in the first circular opening to expose a portion of the cathode; a gate electrode arranged on the insulating layer, the gate electrode including a third circular opening connected to the second circular opening; a plurality of ring shaped emitters arranged on the portion of the cathode exposed in the second opening; and a second substrate facing the first substrate and spaced apart from the first substrate, the second substrate including an anode and a fluorescent layer formed on a surface thereof.

The cathode preferably includes a circular cavity exposing the first substrate, the circular cavity being arranged between the plurality of emitters.

An inner diameter of the first opening is preferably greater than that of the second opening and an inner diameter of the cavity is preferably less than that of the second opening.

An inner diameter of the emitter is preferably less than that of the second opening and is greater than that of the cavity.

An inner diameter of the third opening is alternatively preferably equal to that of the second opening.

An inner diameter of the third opening is alternatively preferably greater than that of the second opening.

At least one of the plurality of emitters preferably contacts a side surface of the insulating layer.

The plurality of emitters preferably comprise a carbon based material.

The plurality of emitters preferably comprise Carbon Nano-Tubes (CNTs).

A plurality of the first, second, and third openings are preferably arranged with respect to one pixel and at least one of the plurality of emitters is preferably arranged in each of the plurality of second openings.

According to yet another aspect of the present invention, a method of manufacturing a Field Emission Display (FED) is provided, the method comprising: forming a cathode on a substrate; forming a conductive layer on the cathode, the conductive layer including a first opening exposing a portion of the cathode; forming an insulating layer covering the cathode and the conductive layer on the substrate; forming a metallic material layer on the insulating layer, the metallic material layer including an aperture smaller than the first opening; etching the insulating layer through the aperture to form a second opening arranged in the first opening and exposing a portion of the cathode; patterning the metallic material layer to form a gate electrode, the gate electrode including a third opening connected to the second opening; and forming an emitter on the portion of the cathode exposed through the second opening.

Forming the cathode preferably comprises depositing an electrically conductive material on the substrate and then patterning it into stripes.

Forming the cathode preferably comprises forming a cavity in the cathode exposing the substrate.

The cavity is preferably formed to be smaller than the second opening.

Forming the conductive layer preferably comprises coating an electrically conductive photosensitive paste on the cathode and then patterning it by exposing and developing it.

The electrically conductive paste is coated by screen printing.

Forming the insulating layer preferably comprises coating an insulating paste material on the substrate by screen printing and then sintering it.

Forming the metallic material layer preferably comprises depositing an electrically conductive metallic material on the insulating layer by sputtering and forming the hole by partially etching the metallic material layer.

Etching the insulating layer preferably comprises using the metallic material layer as an etching mask.

Forming the gate electrode preferably comprises patterning the metallic material layer into stripes.

Forming the emitter preferably comprises: coating a Carbon Nano-Tube (CNT) photosensitive paste inside the second opening; irradiating light behind the substrate to selectively expose to light only a portion of the CNT paste located on the cathode; and removing the remaining portion of the CNT paste not exposed to light to form the emitter of the remaining CNTs.

The substrate preferably comprises a transparent glass and the cathode comprises Indium Tin Oxide (ITO).

Forming the emitter preferably comprises: coating a photoresist inside the second opening and patterning it to remain only on the surface of the cathode; coating a CNT paste inside the second opening; heating the substrate to form the emitter by a thermochemical reaction between the photoresist and the CNT paste; and removing a portion of the CNT paste not undergoing the thermochemical reaction.

Forming the emitter preferably comprises: forming a catalytic metal layer on the surface of the cathode; and vertically growing CNTs from the surface of the catalytic metal layer by supplying a carbon-containing gas to the catalytic metal layer to form the emitter.

The first, second, and third openings are preferably square.

The emitter is preferably formed along both edges of the second opening and is preferably rod shaped.

The first, second, and the third openings are preferably circular.

The emitter is alternatively preferably ring shaped.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein:

FIG. 1A is a partial cross-sectional view of the FED and FIG. 1B is a partial plan view of the FED;

DETAILED DESCRIPTION OF THE INVENTION

Figure 1A:
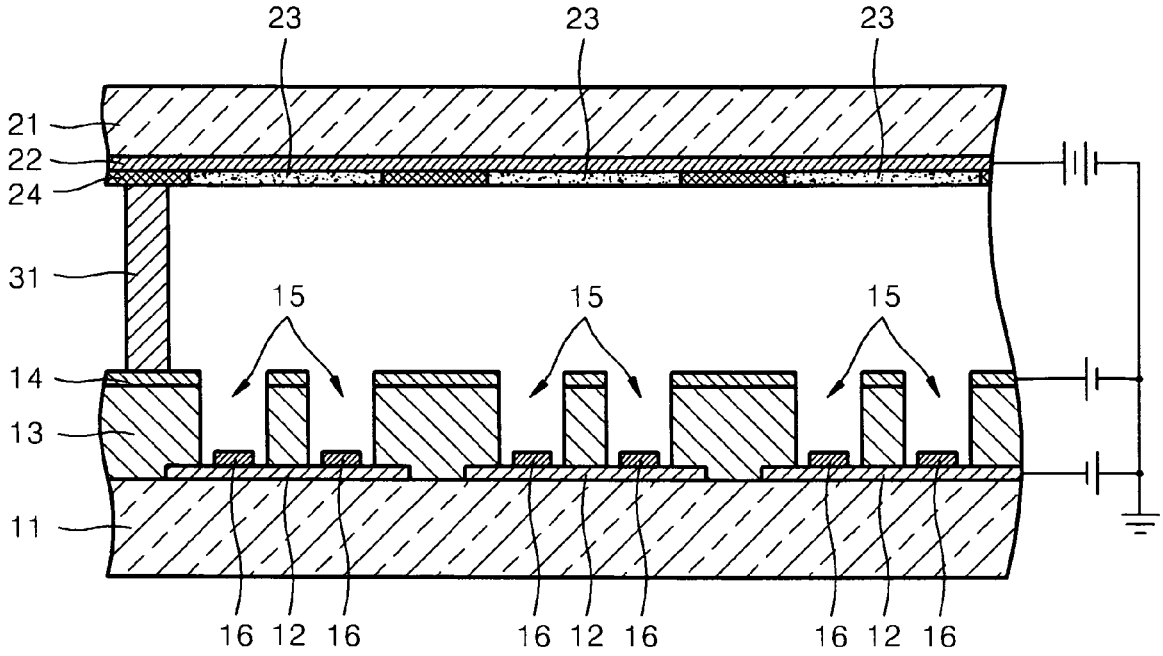
FIG. 1A (PRIOR ART)
FIGS. 1A and 1B are views of a Field Emission Display (FED)
Figure 1B:
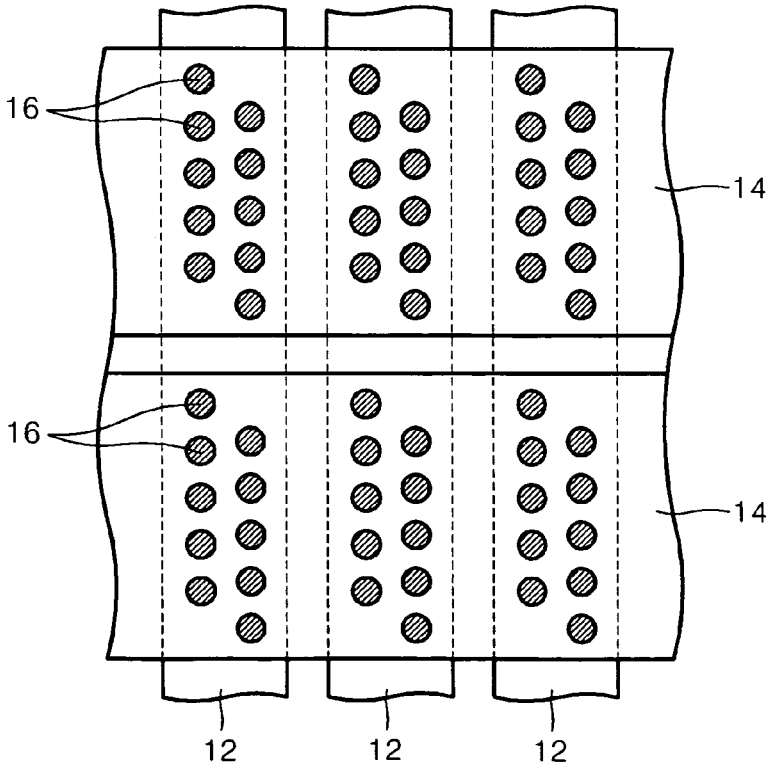
FIG. 1B (PRIOR ART)

FIGS. 1A and 1B are views of an FED, FIG. 1A is a partial cross-sectional view of the FED and FIG. 1B is a partial plan view of the FED.

Referring to FIGS. 1A and 1B, the FED has a triode structure including a cathode 12, an anode 22, and a gate electrode 14. The cathode 12 and the gate electrode 14 are formed on a rear substrate 11 and the anode 22 is formed on a lower surface of a front substrate 21. Fluorescent layers 23, composed of R, G, and B phosphors, and a black matrix 24 for improving contrast are formed on the lower surface of the anode 22. The rear substrate 11 and the front substrate 21 are spaced from each other by a spacer 31 disposed therebetween. In such an FED, the cathode 12 is first formed on the rear substrate 11, an insulating layer 13 and the gate electrode 14 which have fine openings 15 are stacked thereon, and then emitters 16 are disposed on the cathode 12 located in the openings 15.

However, the FED having the triode structure as described above has low color purity during driving and has difficulty in obtaining a clear image. These problems occur because most electrons are emitted from an edge portion of the emitter 16 and an electron beam proceeding toward the fluorescent layer 23 diverges due to the voltage (a positive voltage of several volts through tens of volts) supplied to the gate electrode 14, thereby allowing a phosphor of adjacent other pixel as well as a phosphor of the intended pixel to emit light.

To resolve the above problems, an effort has been made to restrict the electron beam from the emitter 16 from diverging by reducing the area of the emitter 16 corresponding to one pixel to dispose a number of emitters 16. However, it is difficult to form a number of emitters 16 in a pixel of a predetermined size and the entire area of the emitters 16 for allowing a phosphor of the concerned pixel to emit light decreases. Also, the effect of focusing the electron beam is not sufficient.

Figure 2A:
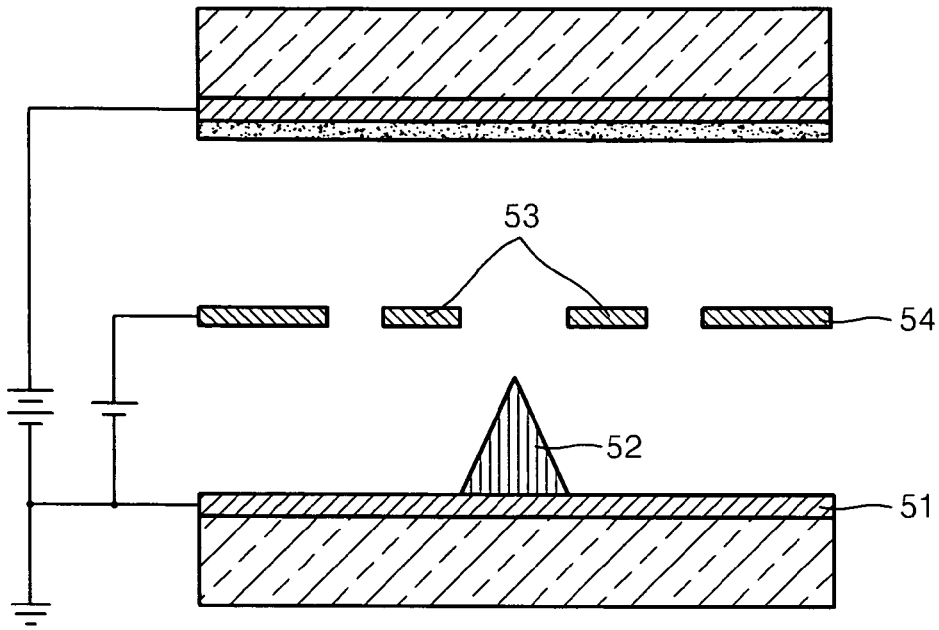
FIG. 2A (PRIOR ART)
FIGS. 2A and 2B are partial cross-sectional views of other examples of an FED.
Figure 2B:
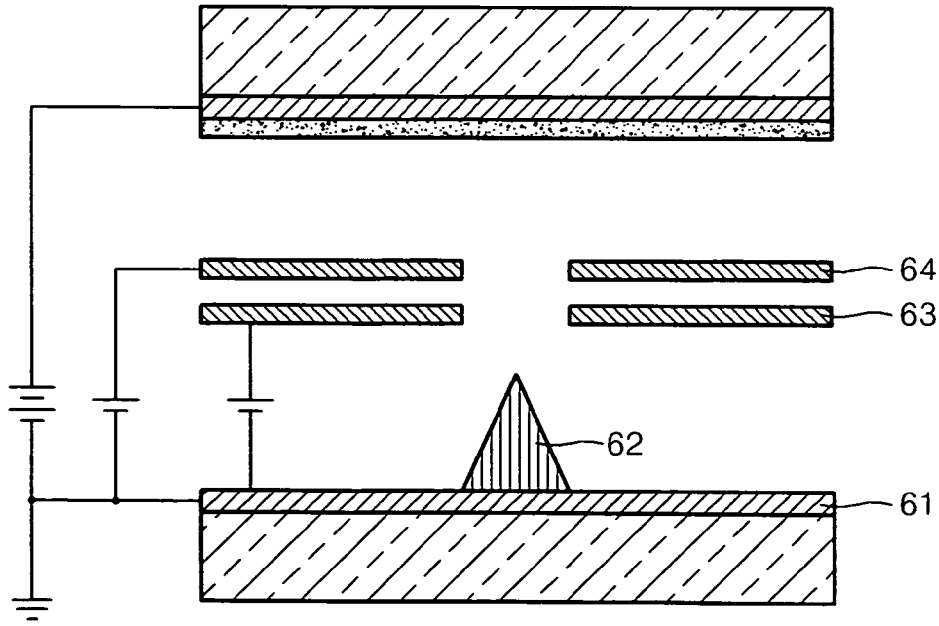
FIG. 2B (PRIOR ART)

In order to prevent the electron beam from diverging, a FED in which a separate electrode 54 or 64 for focusing the electron beam is disposed around the gate electrode 53 or 63, as shown in FIGS. 2A and 2B has been proposed.

FIG. 2A illustrates an FED in which an electron beam is focused by disposing a ring shaped focusing electrode 54 around the gate electrode 53. FIG. 2B illustrates an FED in which an electron beam is focused by using a dual gate composed of a lower gate electrode 63 and an upper gate electrode 64. However, these FEDs have complicated structures. Also, since the above structures have been mainly applied to a FED having a metal tip emitter 52 or 62 formed on the cathode 51 or 61, when the structures are applied to an FED having the flat shape emitter, a satisfactory effect has not yet been obtained.

The present invention will now be described more fully with reference to the accompanying drawings in which embodiments of the invention are shown. In the drawings, like reference numbers refer to like elements throughout, and the sizes of elements can be exaggerated for clarity.

Figure 3:
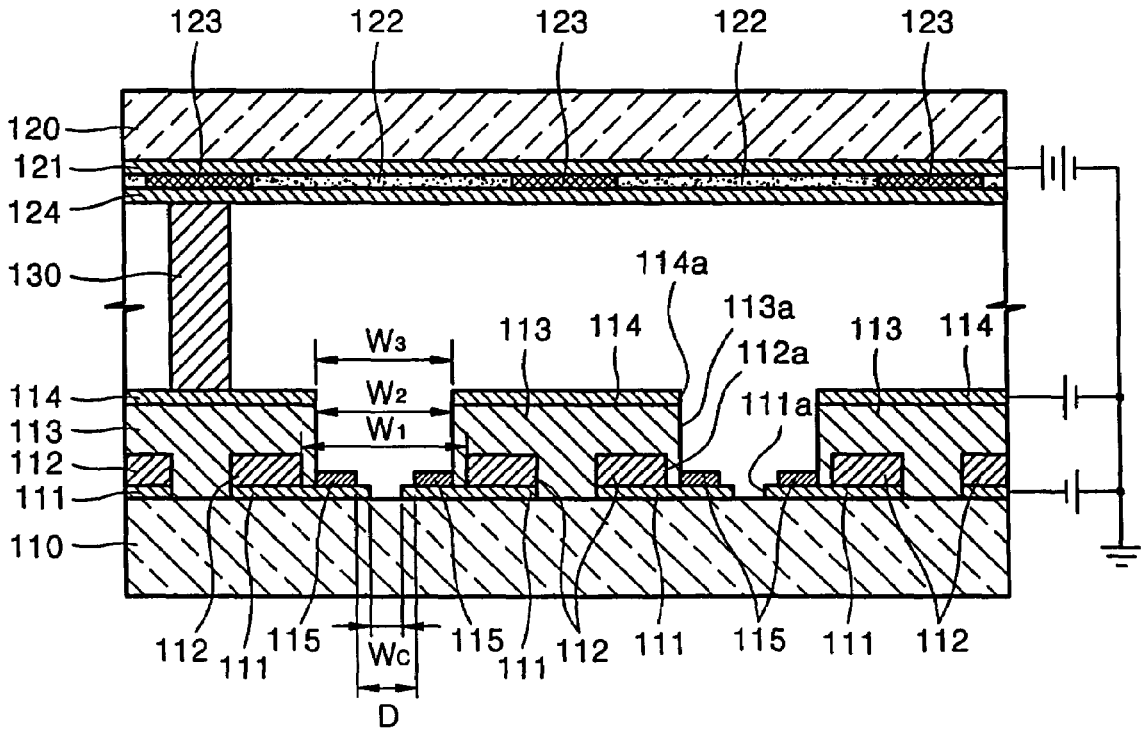
FIG. 3 is a partial cross-sectional view of an FED according to an embodiment of the present invention.
Figure 4:
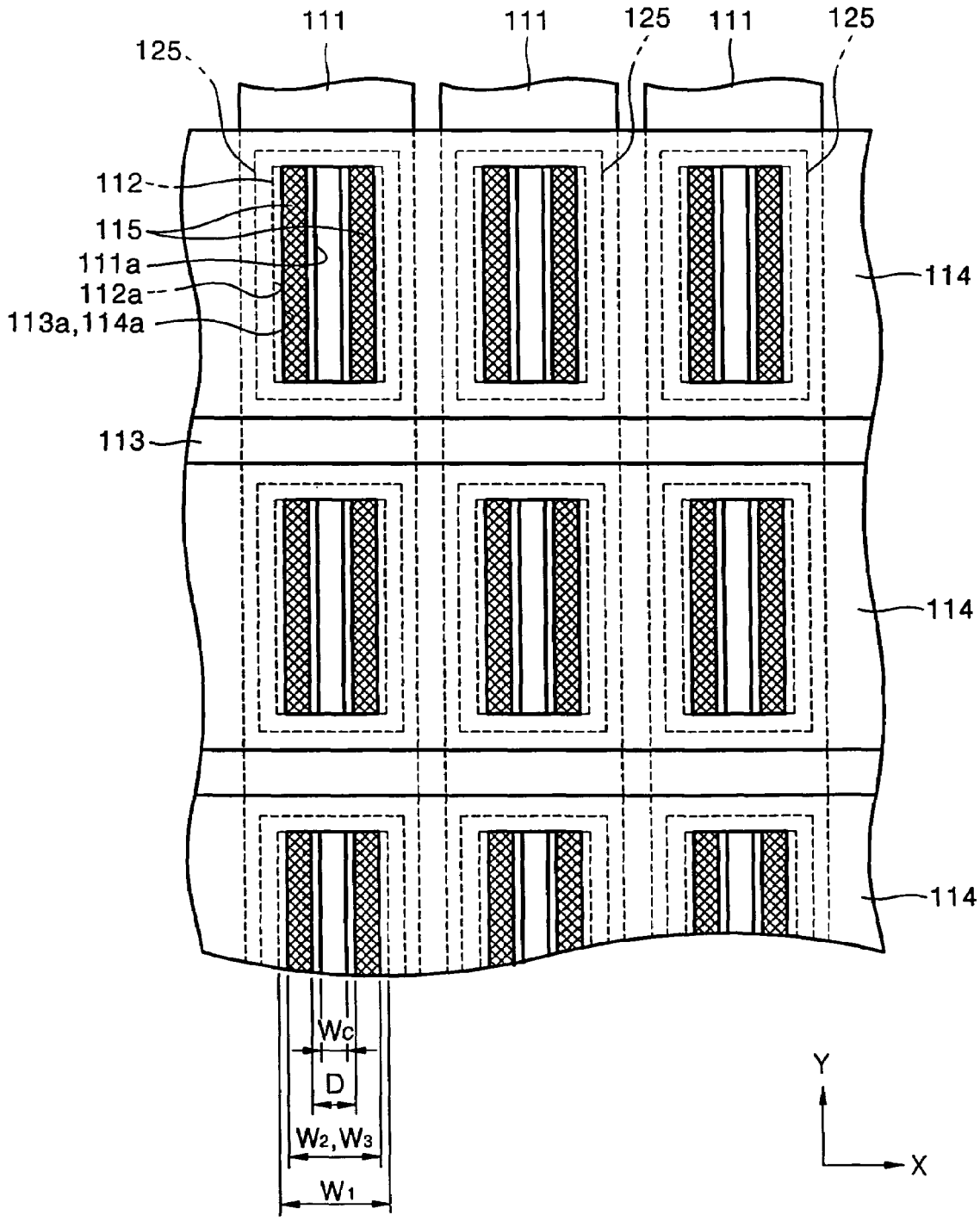
FIG. 4 is a partial plan view of an arrangement of elements formed on a rear substrate in the FED of FIG. 3.

FIG. 3 is a partial cross-sectional view of the structure of a Field Emission Display (FED) according to an embodiment of the present invention and FIG. 4 is a partial plan view of an arrangement of elements formed on a rear substrate in the FED of FIG. 3.

Referring to FIGS. 3 and 4, the FED according to an embodiment of the present invention includes two substrates facing each other and separated by a predetermined distance, i.e., a first substrate 110 which is typically called a rear substrate and a second substrate 120 which is typically called a front substrate. The rear substrate 110 and the front substrate 120 are separated by a uniform distance due to a spacer 130 installed therebetween. A glass substrate is typically used for the rear substrate 110 and the front substrate 120.

A configuration capable of achieving field emission is provided on the rear substrate 110 and a configuration capable of forming a predetermined image by electrons emitted due to field emission is provided on the front substrate 120.

Specifically, a plurality of cathodes 111 arranged at predetermined distances in a predetermined pattern, for example, in the form of stripes, are formed on the rear substrate 110. The cathode 111 can be composed of an electrically conductive metallic material or a transparent electrically conductive material, for example, Indium Tin Oxide (ITO). The material of the cathode 111 varies depending on a method of forming an emitter 115 as described below.

A cavity 111*a* exposing the rear substrate 110 is formed in the cathode 111. The cavity 111*a* is disposed between emitters 115. One cavity 111*a* is formed with respect to one pixel 125 and can have a longitudinally long shape corresponding to a shape of the pixel 125, i.e., a rectangular shape longer in a direction of a length of the cathode 111 (direction Y).

A conductive layer 112 which is electrically coupled to the cathode 111 is formed on the cathode 111. The conductive layer 112 can be formed to a thickness of about 2-5 μm using an electrically conductive metal paste. A first opening 112*a* exposing a part of the cathode 111 is formed in the conductive layer 112. One first opening 112*a* can be formed with respect to one pixel 125 and can have a longitudinally long shape corresponding to a shape of the pixel 125, i.e., a rectangular shape longer in a direction of a length of the cathode 111 (direction Y). When the cavity 111*a* is formed in the cathode 111 as described above, the width ($W_1$) of the first opening 112*a* is greater than the width ($W_c$) of the cavity 111*a*.

An insulating layer 113 is formed on the rear substrate 110 on which the cathode 111 and the conductive layer 112 are formed. The insulating layer 113 covers an upper surface and side surfaces of the conductive layer 112. The insulating layer 113 can be formed to a thickness of about 10-20 μm using an insulating material paste, for example. A second opening 113*a* which is located in the first opening 112*a* to expose a part of the cathode 111 is formed in the insulating layer 113. The second opening 113*a* also has a rectangular shape longer in a direction of a length of the cathode 111 (direction Y) similar to the first opening 112*a* and its width ($W_2$) is less than the width ($W_1$) of the first opening 112*a*. In this manner, the conductive layer 112 is completely covered by the insulating layer 113 so as not to be exposed through the second opening 113*a*. Thus, when forming the second opening 113*a* in the insulating layer 113, the conductive layer 112 is not affected by an etchant. This will be described again later.

A plurality of gate electrodes 114, arranged at predetermined distances in a predetermined pattern, for example, in the form of stripes, are formed on the insulating layer 113. Each gate electrode 114 extends in a vertical direction (direction X) of longitudinal direction of the cathode 111 (direction Y). Each gate electrode 114 can be composed of an electrically conductive metal, for example, chromium (Cr) and can have a thickness of thousands of Å. A third opening 114*a*, connected to the second opening 113*a*, is formed in each gate electrode 114. The third opening 114*a* can have the same shape as the second opening 113*a* and its width ($W_3$) can also be equal to the width ($W_2$) of the second opening 113*a*.

The emitter 115 is formed on the cathode 111 exposed in the second opening 113*a*. The emitter 115 has a thickness smaller than the conductive layer 112 and is flat. The emitter 115 emits electrons by the electric field formed by a voltage supplied between the cathode 111 and the gate electrode 114. In the present invention, carbon based materials, for example, graphite, diamond, Diamond like Carbon (DLC), $C_{60}$ (Fullerene), Carbon Nano-Tubes (CNTs), and the like are used for the emitter 115. In particular, CNTs capable of smoothly causing an electron emission even at a relatively low driving voltage can be used for the emitter 115.

In the present embodiment, the emitters 115 are disposed along both edges of the second opening 113*a* and spaced at predetermined distances. In other words, two emitters 115 are disposed in one second opening 113*a* and are in contact with side surfaces of the insulating layer 113 of both sides of the second opening 113*a* and have rod shapes extending parallel to each other in a direction of a length of the second opening 113*a* (direction Y). Thus, since the emitter 115 can have a broader area than a conventional emitter, the reliability during its lifetime can be ensured even in the case of long driving periods. When the cavity 111*a* is disposed between the emitters 115 as describe above, the distance (D) between the emitters 115 is less than the width ($W_2$) of the second opening 113*a* and is greater than the width ($W_c$) of the cavity 111*a*.

Figure 5A:
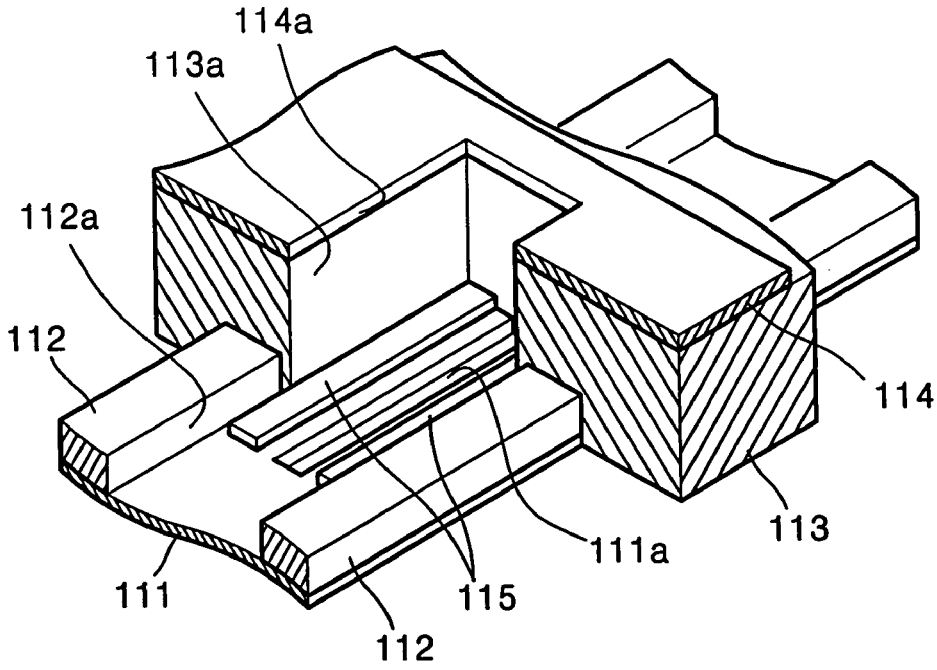
FIGS. 5A through 5C are partial perspective views of three types of a conductive layers formed on a cathode in the FED of FIG. 3.
Figure 5B:
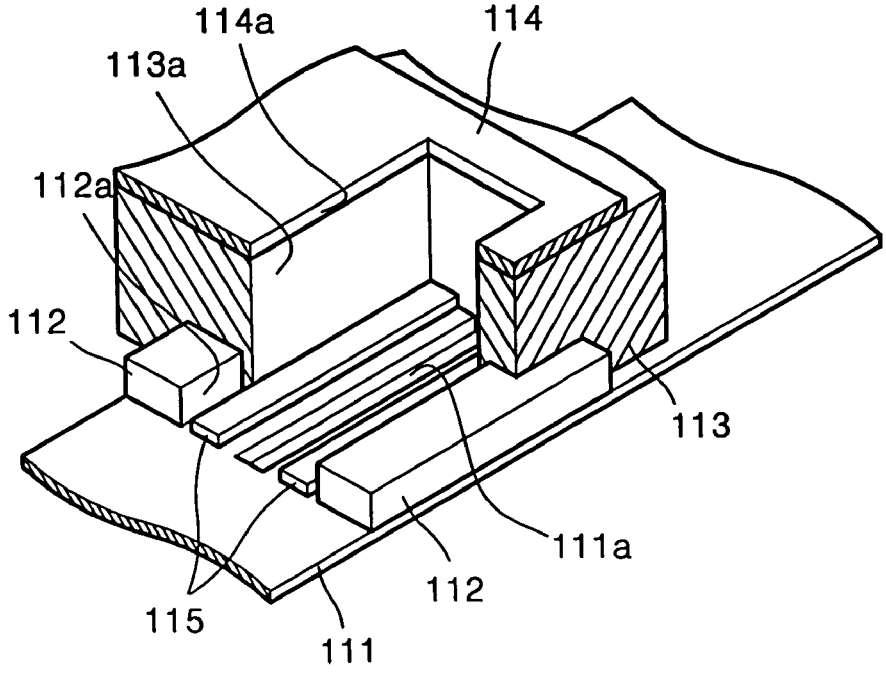
Figure 5C:
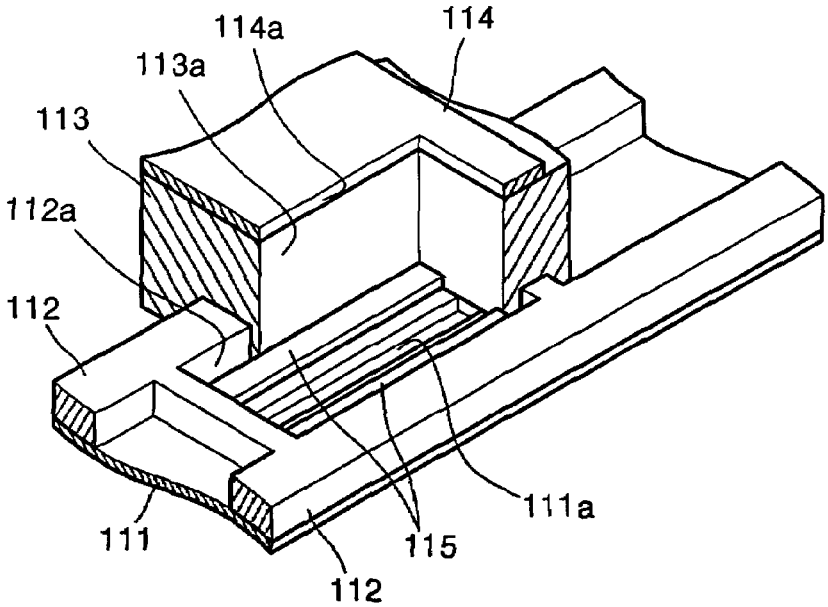

FIGS. 5A through 5C are views of three types of conductive layers 112 formed on the cathode 111.

First, referring to FIG. 5A, the conductive layer 112 can extend in a direction of a length of the cathode 111 along both edges of the cathode 111. In this case, the first opening 112*a* is formed between the conductive layers 112 formed on both sides of the cathode 111. The emitters 115 are in contact with each side surface of the insulating layer 113 of both sides of the second opening 113*a* and have a predetermined length in a direction of a length of the cathode 111. Also, the cavity 111 a formed in the cathode 111 can be disposed between the emitters 115 and can have the same length as that of the emitters 115.

Next, referring to FIG. 5B, the conductive layers 112 can be formed on both edges of the cathode 111 to a predetermined length and the first opening 112*a* can be formed therebetween. In this case, the conductive layers 112 can have the same length ashe emitters 115.

Referring to FIG. 5C, the conductive layer 112 can be formed on the cathode 111 so as to surround the first opening 112*a*. In this case, all four side surfaces of the first opening 112*a* are defined by the conductive layer 112.

Returning to FIGS. 3 and 4, an anode 121 is formed on a surface of the front substrate 120, i.e., a lower surface facing the rear substrate 110 and a fluorescent layer 122 composed of phosphors R, G, and B is formed on the surface of the anode 121. The anode 121 is composed of a transparent electrically conductive material to transmit visible rays emitted from the fluorescent layer 122, for example, ITO. The fluorescent layer 122 has a longitudinally long pattern extending in a direction of a length of the cathode 111 (direction Y).

In the lower surface of the front substrate 120, a black matrix 123 can be formed between the fluorescent layers 122 for improving a contrast.

Also, a metallic thin film layer 124 can be formed on the surfaces of the fluorescent layer 122 and the black matrix 123. The metallic thin film layer 124 is mainly composed of aluminum and has a thickness of hundreds of Å to readily transmit electrons emitted from the emitter 115. This metallic thin film layer 124 acts to improve the luminance. When phosphors R, G, and B of the fluorescent layer 122 are excited by electron beam emitted from the emitter 115 so as to emit visible rays, since the visible rays are reflected by the metallic thin film layer 124, the amount of visible rays emitted by the FED increases, thereby improving the luminance.

When the metallic thin film layer 124 is formed on the front substrate 120, the anode 121 can not be formed. Since the metallic thin film layer 124 is electrically conductive, if a voltage is supplied thereto, the metallic thin film layer 124 can act as the anode 121.

The rear substrate 110 and the front substrate 120 having the above configuration are arranged such that the emitter 115 and the fluorescent layer 122 face each other at a predetermined distance and are joined by a sealing material (not shown) coated around them. A spacer 130 is installed between the rear substrate 110 and the front substrate 120 in order to maintain the distance therebetween.

The operation of the FED according to an embodiment of the present invention having above-described configuration is described below.

When a predetermined voltage is supplied to each of the cathode 111, the gate electrode 114, and the anode 121, electrons are emitted from the emitter 115 while an electric field is formed among these electrodes 111, 114, and 121. A negative voltage between 0 and tens of volts is supplied to the cathode 111, a positive voltage between 0 and tens of volts is supplied to the gate electrode 114, and a positive voltage between hundreds and thousands of volts is supplied to the anode 121. Since the conductive layer 112 is in contact with the upper surface of the cathode 111, a voltage equal to the voltage supplied to the cathode 111 is simultaneously supplied to the conductive layer 112. Electrons emitted from the emitter 115 form an electron beam and the electron beam proceeds toward the anode 121 and collides with the fluorescent layer 122. As a result, phosphors R, G, and B of the fluorescent layer 122 are excited to emit visible rays.

Since the emitters 115 are disposed on both sides of the second opening 113*a*, the electron beam formed by the electrons emitted from the emitters 115 can be focused without being widely diverged. Also, since the conductive layers 112, which are higher than the emitters 115, are formed on both outer sides of the emitters 115, focusing of the electron beam is more efficient due to the electric field induced by the conductive layer 112.

When forming the cavity 111*a* in the cathode 111, equipotential lines of an electric field are formed to surround the emitter 115. Due to the effect of the electric field, the current density increases, and thus, the luminance of an image increases, thereby lowering the driving voltage. Also, since the electron beam can be more effectively focused by adjusting the width ($W_c$) of the cavity 111*a*, the peak current density can be accurately located in a corresponding pixel.

As described above, in the FED according to an embodiment of the present invention, focusing of the electron beam emitted from the emitter 115 is improved, a current density increases, and a color purity and a luminance of an image are improved since the peak current density is accurately located in a corresponding pixel, thereby attaining a high quality image.

The advantages of the FED according to an embodiment of the present invention as described above will be further described with reference to simulation results later.

Figure 6:
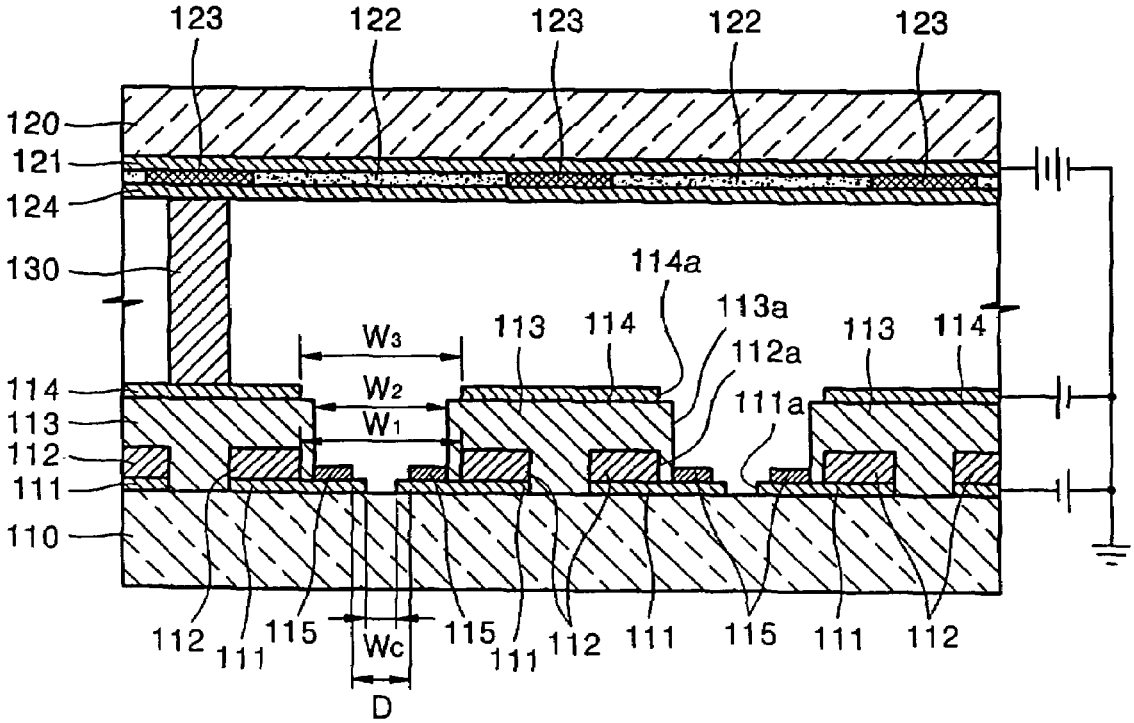
FIG. 6 is a partial cross-sectional view of a modification of the FED of FIG. 3.

FIG. 6 is a partial cross-sectional view of a modification of the FED according to an embodiment of the present invention of FIG. 3.

Referring to FIG. 6, the width ($W_3$) of the third opening 114*a* formed in the gate electrode 114 can be greater than the width ($W_2$) of the second opening 113*a* formed in the insulating layer 113. When the width ($W_3$) of the third opening 114*a* is greater than the width ($W_2$) of the second opening 113*a*, the distance between the cathode 111 and the gate electrode 114 increases, and thus, a withstand voltage characteristic is improved.

Other embodiments of the present invention are described below.

Figure 7:
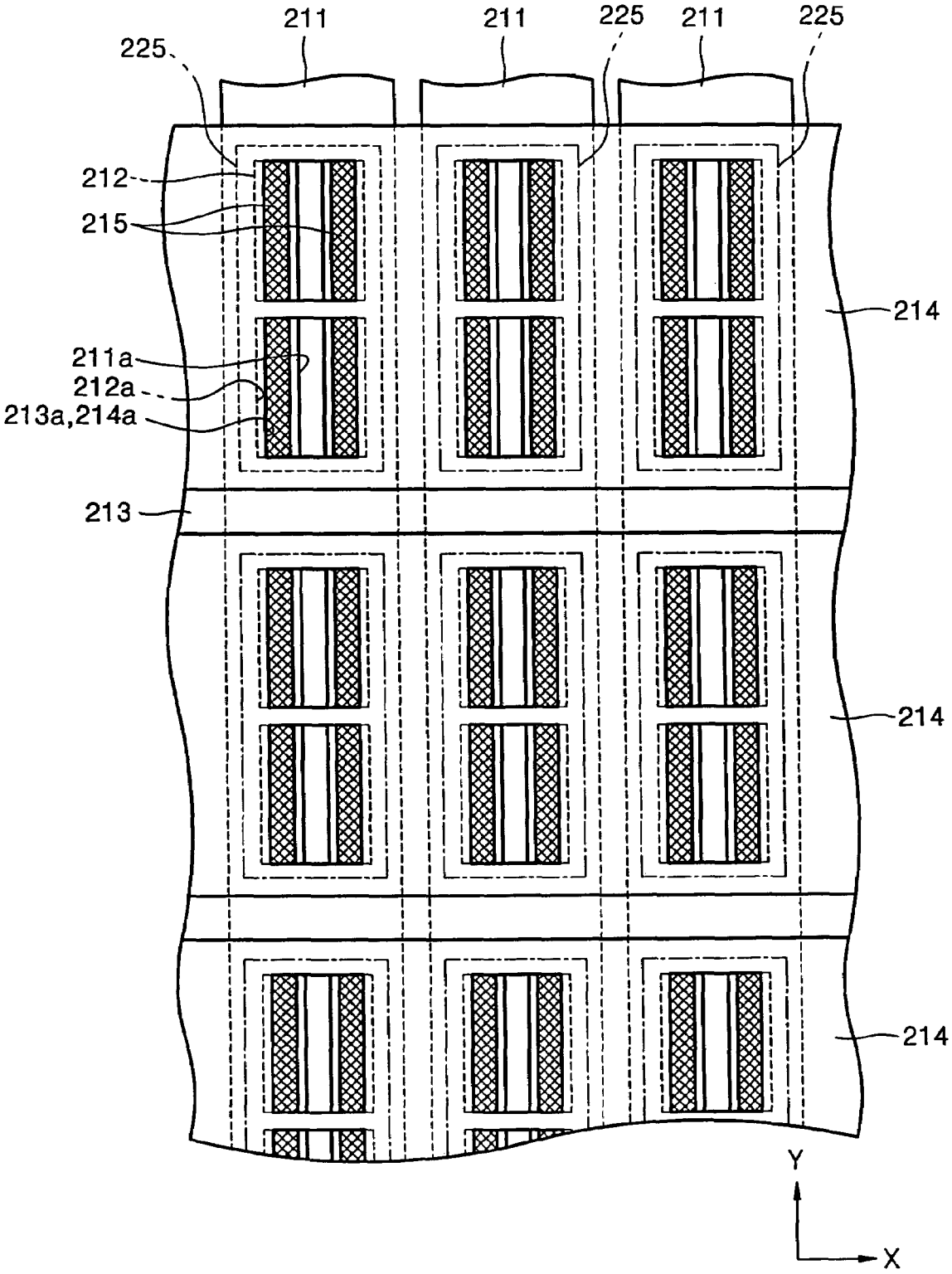
FIG. 7 is a partial plan view of an FED according to another embodiment of the present invention.

FIG. 7 is a partial plan view of the structure of a FED according to another embodiment of the present invention. Since the cross-sectional structure of the FED according to another embodiment of the present invention is the same as that of the FED according to an embodiment of the present invention of FIG. 4, its illustration has been omitted.

Referring to FIG. 7, in this embodiment, there are multiple first openings 212*a*, for example, two first openings 212*a*, formed in a conductive layer 212, multiple second openings 213*a*, for example, two second openings 213*a*, formed in an insulating layer 213, and multiple third openings 214*a*, for example, two third openings 214*a*, formed in a gate electrode 214 with respect to one pixel 225. Emitters 215 are formed inside each of the multiple second openings 213*a*. The emitters 215 are formed on a cathode 211 exposed in the second openings 213*a* and disposed along both edges of the second opening 213*a* and spaced apart by a predetermined distance.

In the present embodiment, a cavity 211 a can be also formed in the cathode 211 and there are multiple cavities 211*a*, for example, two cavities 211*a*, with respect to one pixel 225.

In the present embodiment, since other structures except for the above-described structure are the same as in the previous embodiment, detailed descriptions thereof have been omitted. Also, the modification of FIG. 6 can be included with the present embodiment.

Figure 8:
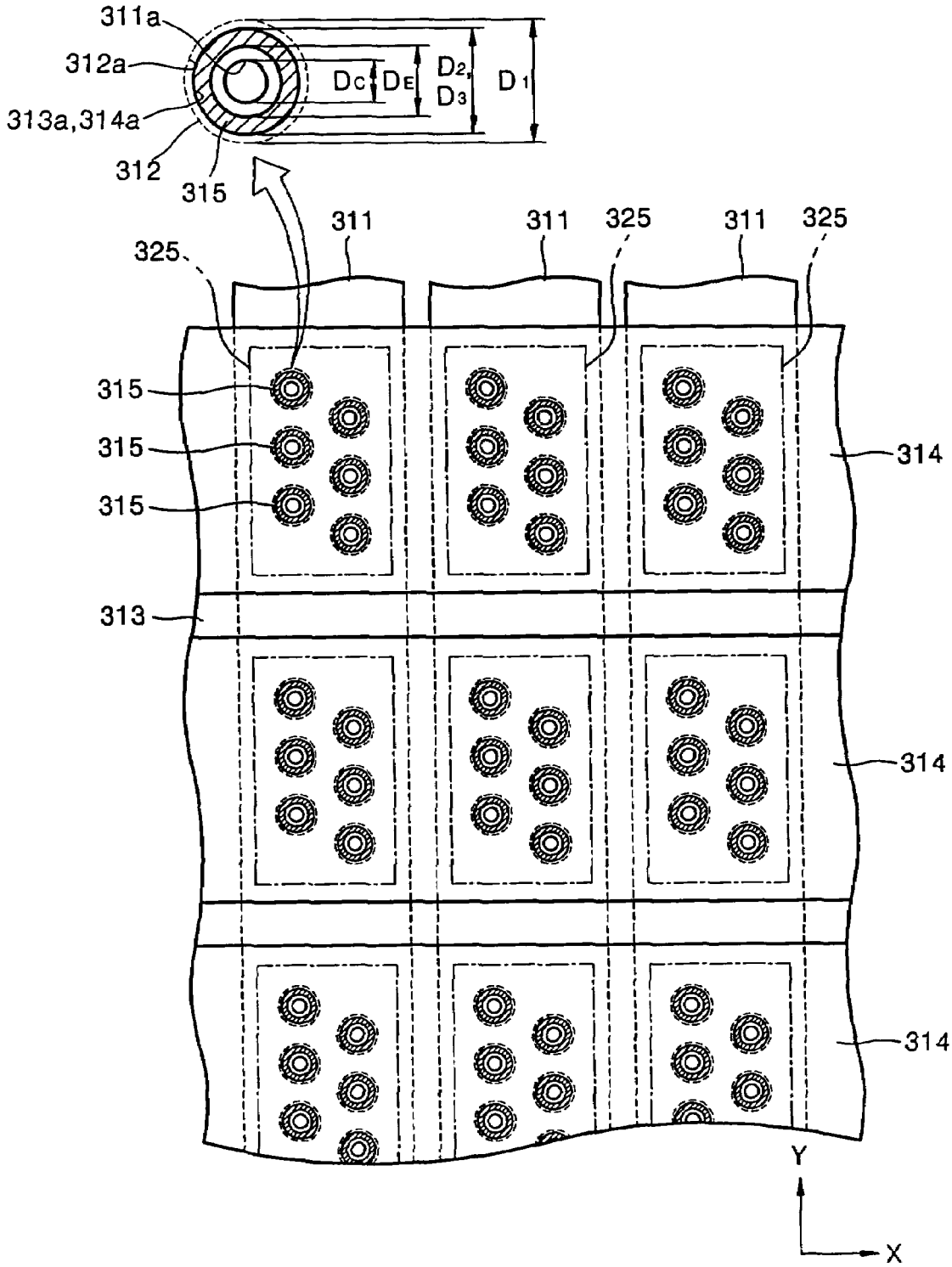
FIG. 8 is a partial plan view of an FED according to still another embodiment of the present invention.

FIG. 8 is a partial plan view of the structure of a FED according to still another embodiment of the present invention. Since the cross-sectional structure of the FED according to still another embodiment of the present invention is also the same as that of the FED according to an embodiment of the present invention of FIG. 4, its illustration has been omitted.

Referring to FIG. 8, a first opening 312*a* formed in a conductive layer 312, a second opening 313*a* formed in an insulating layer 313, and a third opening 314*a* formed in a gate electrode 314 have a circular shape. The inner diameter ($D_2$) of the second opening 313*a* is less than the inner diameter ($D_1$) of the first opening 312*a*. The inner diameter ($D_3$) of the third opening 314*a* can be equal to the inner diameter ($D_2$) of the second opening 313*a*.

A ring shaped emitter 315 is formed on a cathode 311 exposed in the second opening 313*a*. The emitter 315 is formed such that its circumference is in contact with the side surface of the insulating layer 313. The inner diameter ($D_E$) of the emitter 315 is less than the inner diameter ($D_2$) of the second opening 313*a*. The emitter 315 can be composed of a carbon based material, for example, carbon nano-tubes.

In the present embodiment, a circular cavity 311*a* exposing a rear substrate (not shown) can also be formed in the cathode 311 and the cavity 311*a* is disposed inside the ring shaped emitter 315. Thus, the inner diameter ($D_C$) of the cavity 311*a* is less than each of the inner diameter ($D_2$) of the second opening 313*a* and the inner diameter ($D_E$) of the emitter 315.

In the FED according to the present embodiment, multiple first openings 312*a*, multiple second openings 313*a*, and multiple third openings 314*a* can be formed with respect to one pixel 325. The ring shaped emitter 315 is formed inside each of multiple second openings 313*a*.

In the present embodiment, since other structures except for the above-described structure are the same as in an embodiment described above, detailed descriptions thereof have been omitted.

The modification of FIG. 6 can also be included with the present embodiment. In other words, the inner diameter ($D_3$) of the third opening 314*a* formed on the gate electrode 314 can be greater than the inner diameter ($D_2$) of the second opening 313*a* formed in the insulating layer 313.

A method of manufacturing a FED according to an embodiment of the present invention having the construction as described above is described below. Although the method described below is based on the FED of FIG.3, the method can also be applied to the FEDs of FIGS. 6 through 8.

FIGS. 9A through 9H are cross-sectional views of the method of manufacturing the FED according to an embodiment of the present invention.

Figure 9A:
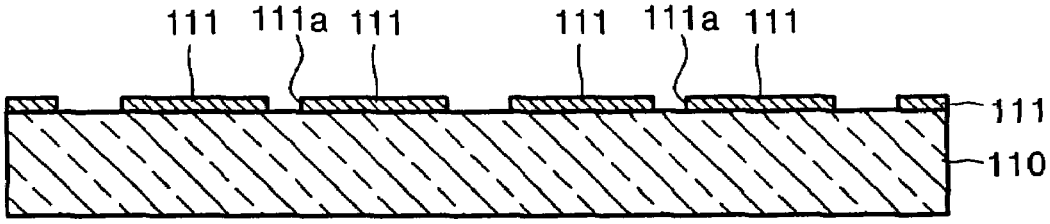
FIGS. 9A through 9H are cross-sectional views sequentially of a method of manufacturing an FED according to an embodiment of the present invention.

First, referring to FIG. 9A, a substrate 110 is prepared, and then a cathode 111 is formed on the substrate 110. A transparent substrate, for example, a glass substrate is used as the substrate 110 for back exposure as described below. The cathode 111 is composed of a transparent electrically conductive material, for example, ITO for the same reasons noted above. Specifically, the cathode 111 can be formed by depositing ITO on the glass substrate 110 to a predetermined thickness, for example, hundreds through thousands of Å and then patterning the ITO in the form of a stripe. The patterning of ITO can be performed by well-known methods of patterning a material layer, for example, by forming an etching mask through coating of a photoresist, exposing and developing and then etching the ITO using the etching mask.

During forming the cathode 111, a cavity 111*a* of a predetermined shape can be formed in the cathode 111. The cavity 111*a* and the cathode 111 can be simultaneously formed through patterning the ITO as described above. The cavity 111*a* can have a rectangular shape longer in a direction of a length of the cathode 111 (direction Y).

When manufacturing the FED of FIG. 8, a circular cavity is formed in the cathode.

Figure 9B:
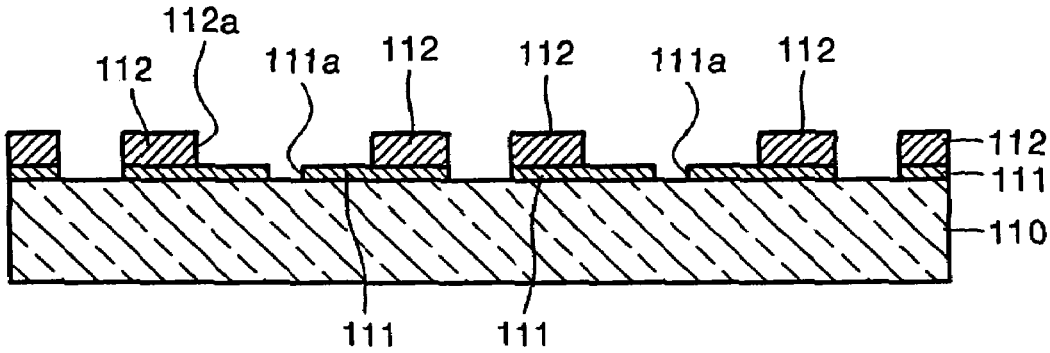

Then, as illustrated in FIG. 9B, a conductive layer 112 electrically coupled to the cathode 111 is formed on the cathode 111. Specifically, the conductive layer 112 can be formed by coating an electrically conductive, photosensitive paste on the cathode 111 to a predetermined thickness, through a screen printing method and then by patterning it through exposure and development. A first opening 112*a* exposing a part of the cathode 111 is formed in the conductive layer 112. The conductive layer 112 and the first opening 111*a* can be formed as illustrated in FIGS. 5A through 5C and the width of the first opening 112*a* is much greater than that of the cavity 111*a*.

As illustrated in FIG. 8, the first opening can be in the form of circle and the diameter of the first opening is much greater than that of the cavity.

Figure 9C:
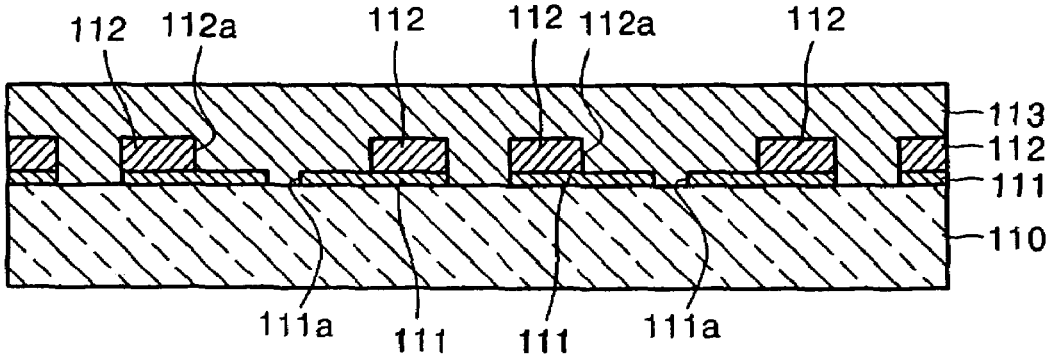

FIG. 9C illustrates an insulating layer 113 formed on the resultant structure of FIG. 9B. Referring to FIG. 9C, for example, an insulating material paste is coated on the substrate 110 having the cathode 111 and the conductive layer 112 formed through screen printing, and then is sintered at a predetermined temperature to form an insulating layer 113 having a thickness of about 10-20 μm.

Figure 9D:
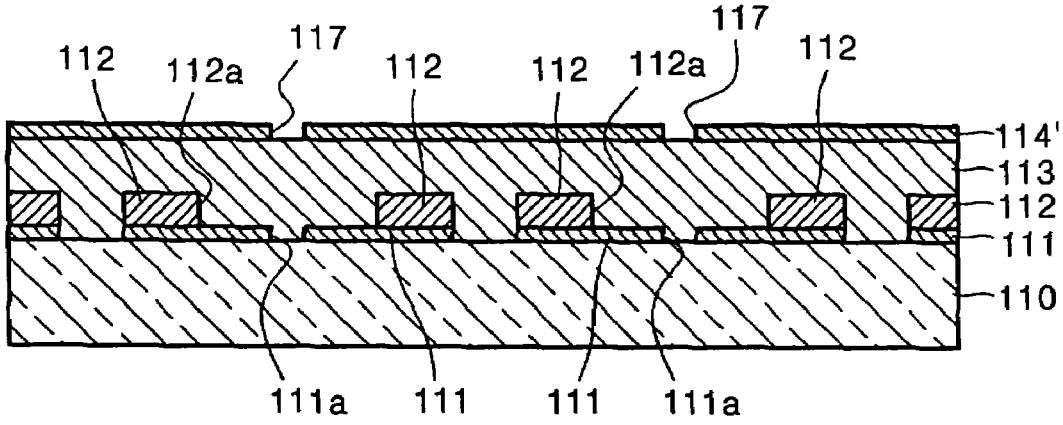

Then, as illustrated in FIG. 9D, a metallic material layer 114' is formed on the insulating layer 113. The metallic material layer 114' will form a gate electrode 114 later and can be formed by depositing an electrically conductive metal, for example, chromium (Cr) to a thickness of thousands of Å via sputtering. Then, holes 117 are formed in the metallic material layer 114'. The holes 117 can be formed by forming an etching mask through coating, exposing to light, and developing a photoresist and then by partially etching the metallic material layer 114' using the etching mask. Each hole 117 is formed in the position corresponding to the first opening 112*a* formed in the conductive layer 112 and has a rectangular shape a width of which is less than that of the first opening 112*a*.

When the first circular opening is formed as illustrated in FIG. 8, the hole also has circular shape of which the diameter is less than that of the first opening.

Then, the insulating layer 113 exposed through the hole 117 is etched using the metallic material layer 114' as an etching mask until the cathode 111 is exposed.

Figure 9E:
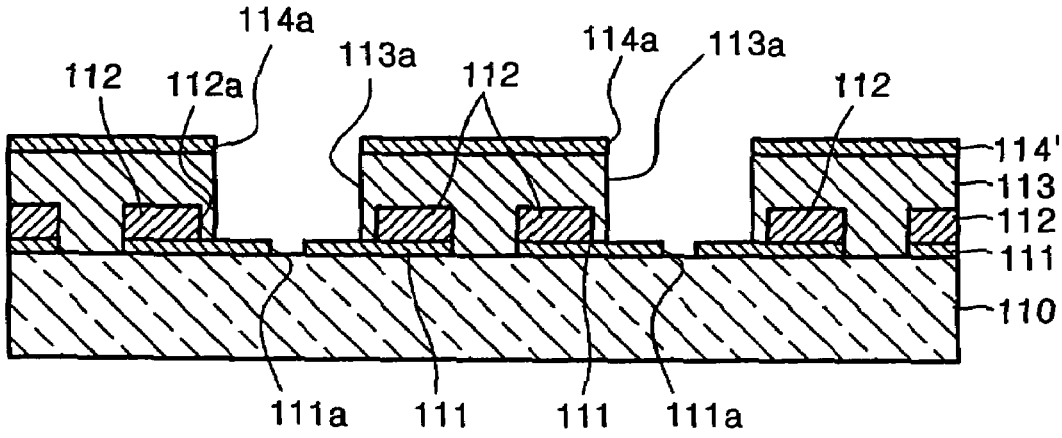

As a result, as illustrated in FIG. 9E, a rectangular second opening 113*a* located in the first opening 112*a* and exposing a part of cathode 111 is formed in the insulating layer 113. Consequently, the upper surface and the side surfaces of the conductive layer 112 are completely covered by the insulating layer 113, and thus are not externally exposed. Thus, when forming the second opening 113*a* in the insulating layer 113, the conductive layer 112 composed of the electrically conductive metal paste is not affected by an etchant, thereby eliminating damage to the conductive layer 112 due to the etchant.

When forming a circular hole in order to manufacture the FED of FIG. 8, the second opening formed in the insulating layer also has a circular shape.

Then, the metallic material layer 114' is patterned in the form of a stripe to form the gate electrode 114. The patterning of the metallic material layer 114' can be performed using the general method of patterning a material layer as described above. A third opening 114*a* is formed in the gate electrode 114. The third opening 114*a* has the same shape as the second opening 113*a* and is connected to the second opening 113*a*. The width of the third opening 114*a* can be equal to or greater than that of the second opening 113*a*.

Figure 9F:
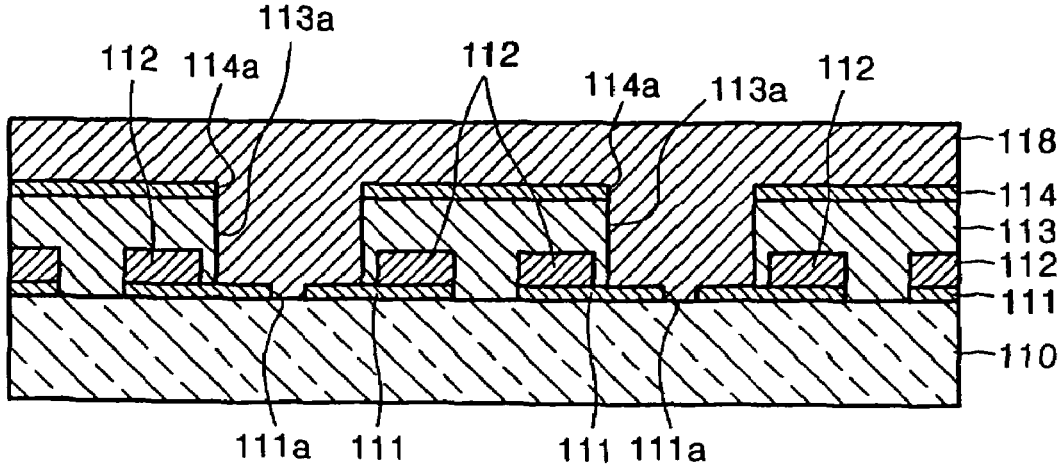
Figure 9G:
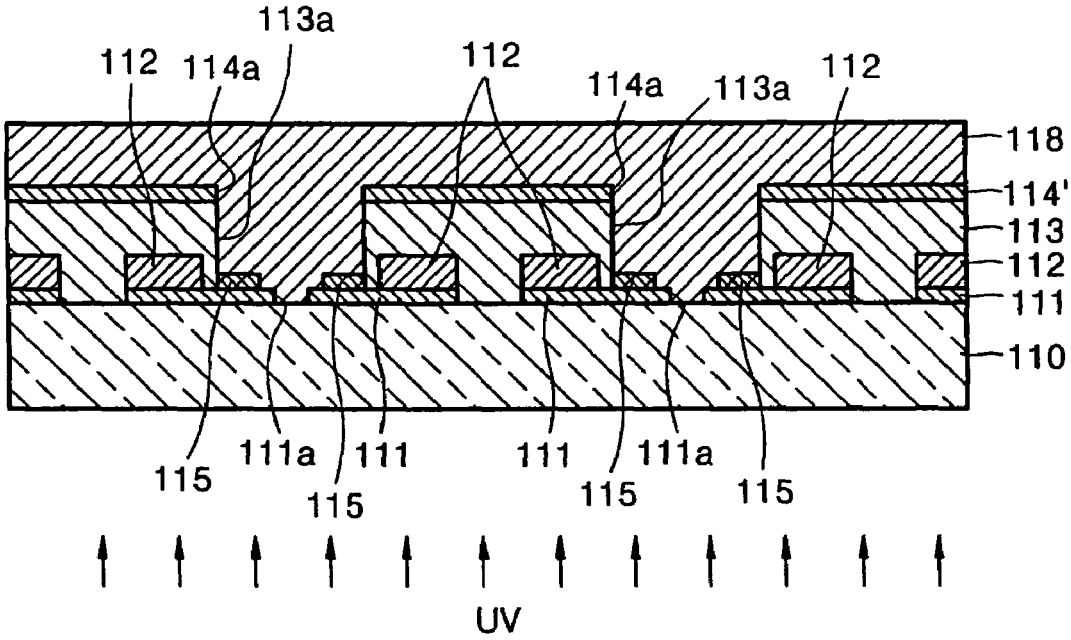
Figure 9H:
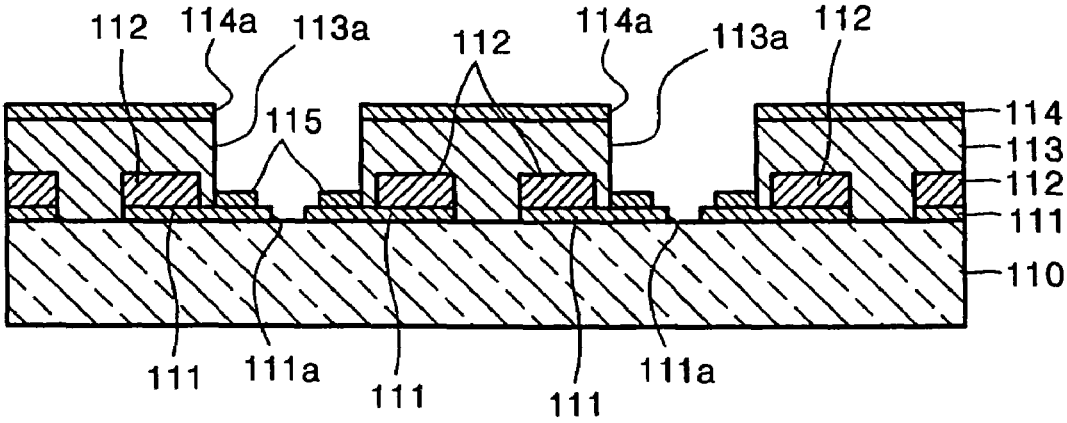

FIGS. 9F through 9H are views of a method of forming an emitter 115 on the cathode 111.

First, as illustrated in FIG. 9F, a CNT photosensitive paste 118 is coated on the entire surface of the resultant structure of FIG. 9E through a screen printing method. The CNT photosensitive paste 118 must completely fill the second opening 113*a*.

Then, as illustrated in FIG. 9G, light, for example, Ultra Violet rays (UV) are irradiated behind the substrate 110 so as to selectively expose only the CNT photosensitive paste 118 formed on the cathode 111. If the amount of exposure is controlled, the depth of the CNT photosensitive paste 118 exposed can be controlled.

Instead of the back exposure, exposure from the front of the substrate 110 can be performed by using a separate photomask.

Then, if the CNT photosensitive paste 118 which is not exposed to light is removed, only the exposed CNT paste remains to form the CNT emitter 115 as illustrated in FIG. 9H. Consequently, the emitters 115 are formed on the cathode 111 exposed in the second opening 113*a* and are disposed along both edges of the second opening 113*a* and spaced apart by a predetermined distance. The emitter 115 has a thickness less than the conductive layer 112, for example, a thickness of about 0.5-4 μm and is flat.

When the second opening is in the form of a circle as illustrated in FIG. 8, a ring-shaped emitter is formed.

Figure 10A:
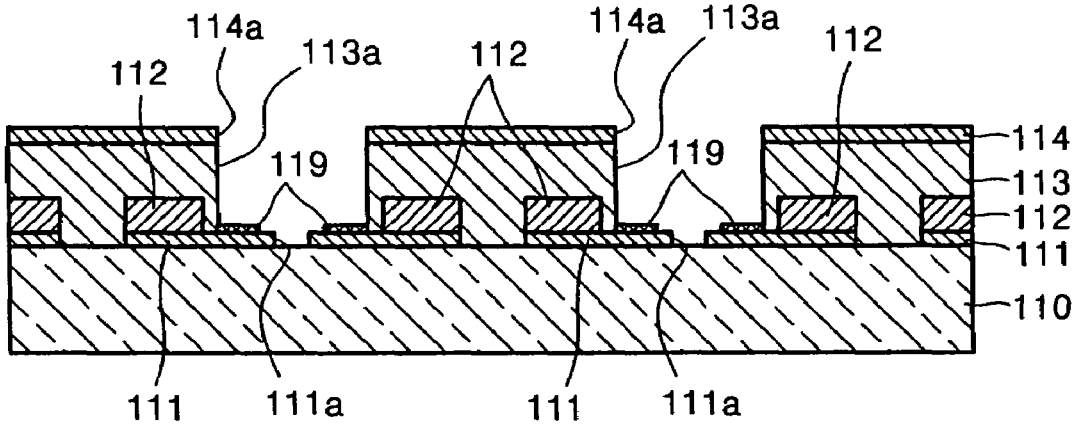
FIGS. 10A through 10C are cross-sectional views of another method of manufacturing an FED according to an embodiment of the present invention.
Figure 10B:
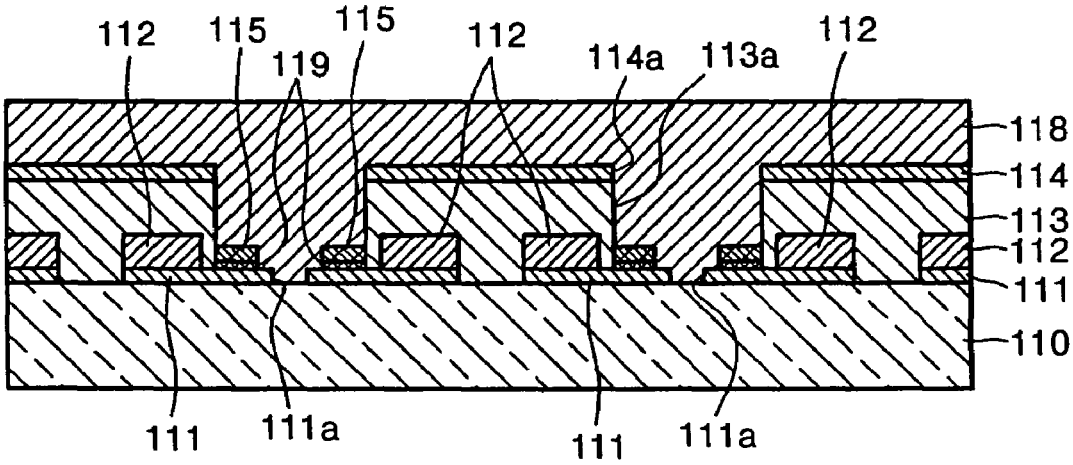
Figure 10C:
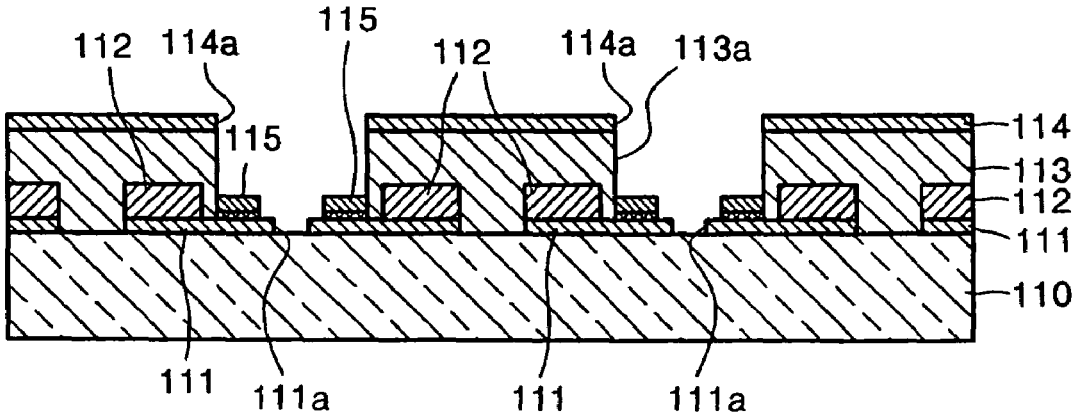

FIGS. 10A through 10C are cross-sectional views of another method of manufacturing the FED according to an embodiment of the present invention.

The method described below is substantially equal to that described above except for the operations of forming an emitter. Thus, this method also includes the steps of FIGS. 9A through 9E.

However, since this method does not use the back exposure, it is not necessary for the substrate 110 and the cathode 111 to be transparent. In other words, in this method, other substrates having good processibility, for example, a silicone substrate or a plastic substrate as well as a glass substrate can be used as the substrate 110 and an opaque electrically conductive metallic material as well as ITO can be used as the cathode 111.

In this method, after performing the operations of FIGS. 9A through 9E, a photoresist 119 is coated on a surface of the cathode 111 exposed through the second opening 113*a* as illustrated in FIG. 10A. Specifically, the photoresist 119 is coated in the second opening 113*a*, and then, patterned so as to remain only on the surface of the cathode 111 on which the emitter 115 will be located.

Then, as illustrated in FIG. 10B, a CNT paste 118 is coated on the entire surface of the resultant structure of FIG. 10A through a screen printing method. The CNT paste 118 must completely fill the second opening 113*a*. Then, the substrate 110 is heated to a predetermined temperature, for example, approximately 80° C. or higher. Thus, the photoresist 119 and the CNT paste 118 undergo a thermochemical reaction to form a CNT emitter 115.

Then, if the CNT paste 118 that does not undergo a thermochemical reaction is removed, the CNT emitter 115 having a predetermined thickness is formed on the surface of the cathode 111 as illustrated in FIG. 10C.

The CNT emitter 115 can be formed in another manner. In the operation of FIG. 10A, instead of the photoresist 119, a catalytic metal layer composed of Ni or Fe is formed on the surface of the cathode 111 on which the emitter 115 will be located, and then, carbon containing gas such as $CH_4$, $C_2H_2$ or $CO_2$ is supplied to the catalytic metal layer to vertically grow the CNT from the surface of the catalytic metal layer, thereby forming the emitter 115.

Hereinafter, simulation results for an electron beam emission of an FED and the FED according to an embodiment of the present invention will be described.

In the present simulation, the FED having the structure of FIG. 1 was used as the comparison FED. Since FEDs according to three embodiments of the present invention have substantially identical cross-sectional structures, their electron beam emission properties are substantially similar. Thus, the simulation for electron beam emission was performed with respect to the FED according to an embodiment of the present invention of FIG. 3.

Before performing the simulation, design parameters of the elements of the FED required for the simulation were set. For example, when a screen of the FED has an aspect ratio of 16:9 and its diagonal line is 38 inches, if horizontal resolution is designed as 1280 lines in order to obtain the image quality of HD grade, and the R, G, B trio-pitch is set to about 0.69 mm.

In this case, the height of the insulating layer can be set to 10-20 μm, the height of the conductive layer can be set to 2-5 μm, the width ($W_1$) of the first opening formed in the conductive layer can be set to 70-90 μm, the width ($W_2$) of the second opening formed in the insulating layer can be set to 60-80 μm, and the width ($W_3$) of the third opening formed in the gate electrode can be set to 60-90 μm. The width ($W_C$) of the cavity formed in the cathode can be set to 10-30 μm.

However, it is apparent that dimensions of elements defined above can vary depending on preconditions such as size, aspect ratio, and resolution of the screen of the FED.

Figure 11A:
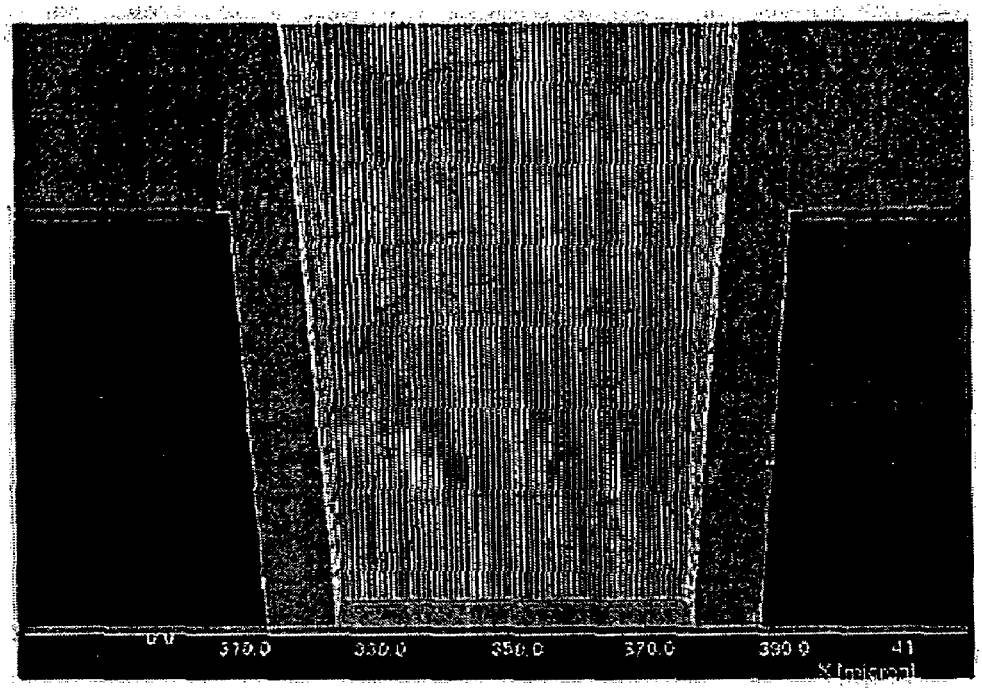
FIGS. 11A through 11C are simulation results for an electron beam emission of an FED of FIG. 1.
Figure 11B:
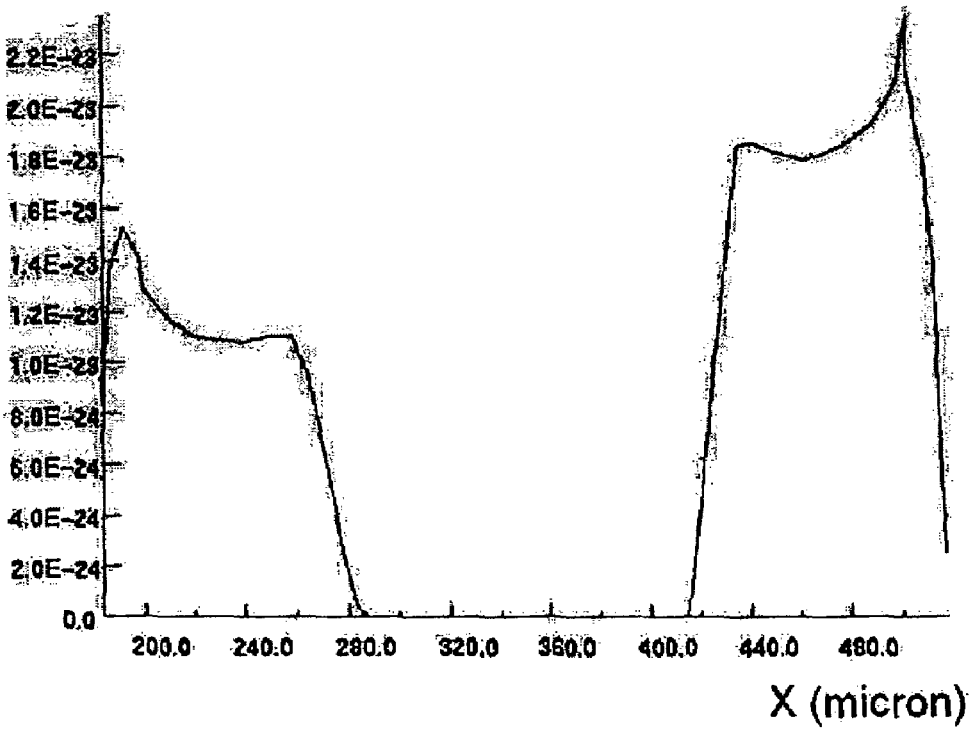
Figure 11C:
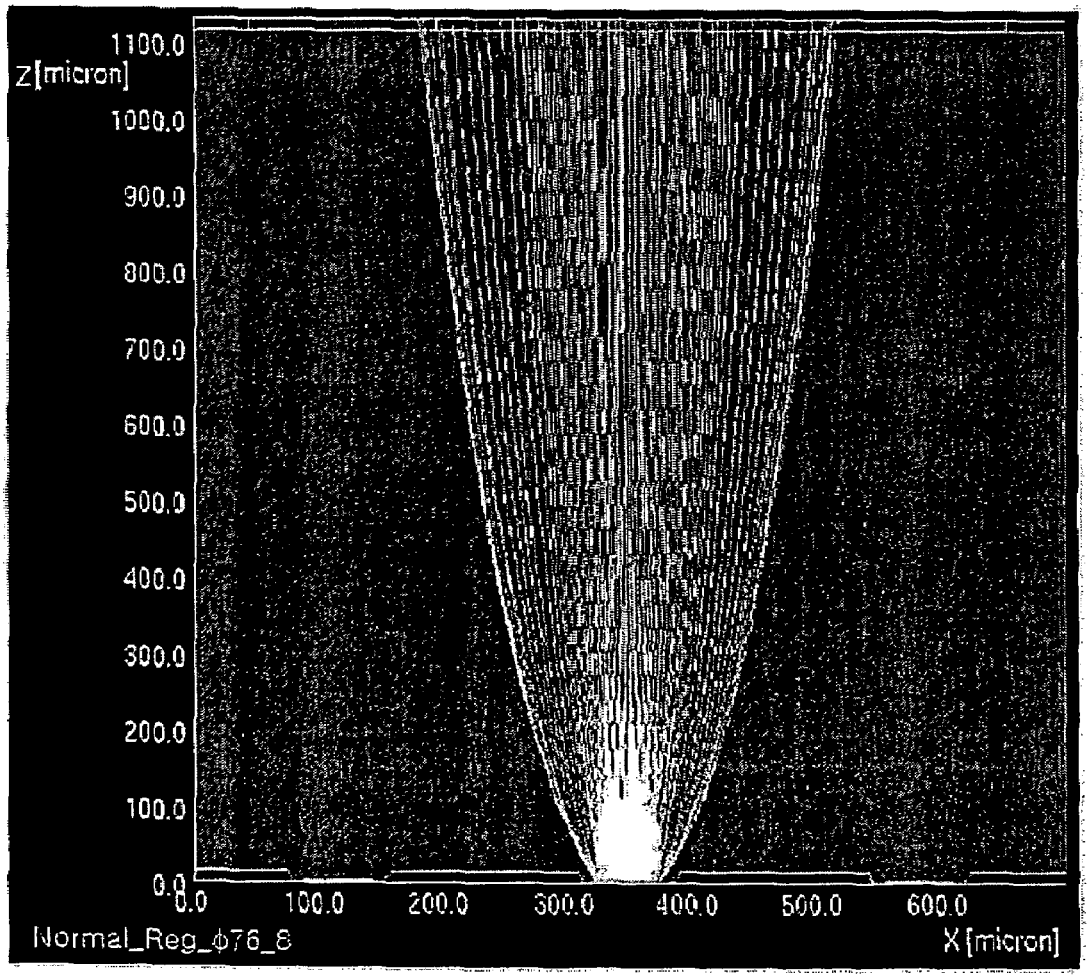

FIGS. 11A through 11C are views of simulation results for electron beam emission of the FED of FIG. 1.

First, referring to FIG. 11A, electron beam emitted from an emitter gradually widely diverges while proceeding toward the fluorescent layer.

In FIG. 11B, the longitudinal axis represents a current density and a peak of the current density is located at the edge portion of a pixel. This is because electrons are mainly emitted from the edge portion of the emitter. If the current density at the central portion of a pixel is low, phosphors of the pixel are not sufficiently excited, thereby lowering the luminance.

Consequently, as illustrated in FIG. 11C, the size of a spot of the electron beam on the fluorescent layer is larger than that of the pixel, so that the electron beam invades other adjacent pixels as well as the desired pixel. In particular, when the emitter is not formed in an accurate position in the opening or when an accurate arrangement is not achieved upon joining the front substrate and the rear substrate, the peak of current density is highly inclined toward the edge portion of the concerned pixel or departs from the concerned pixel so as to excite phosphors of other pixels as well, thereby considerably lowering the color purity.

As described above, in the FED having the structure of FIG. 1, the color purity is lowered and it is difficult to achieve a clear image quality.

Figure 12A:
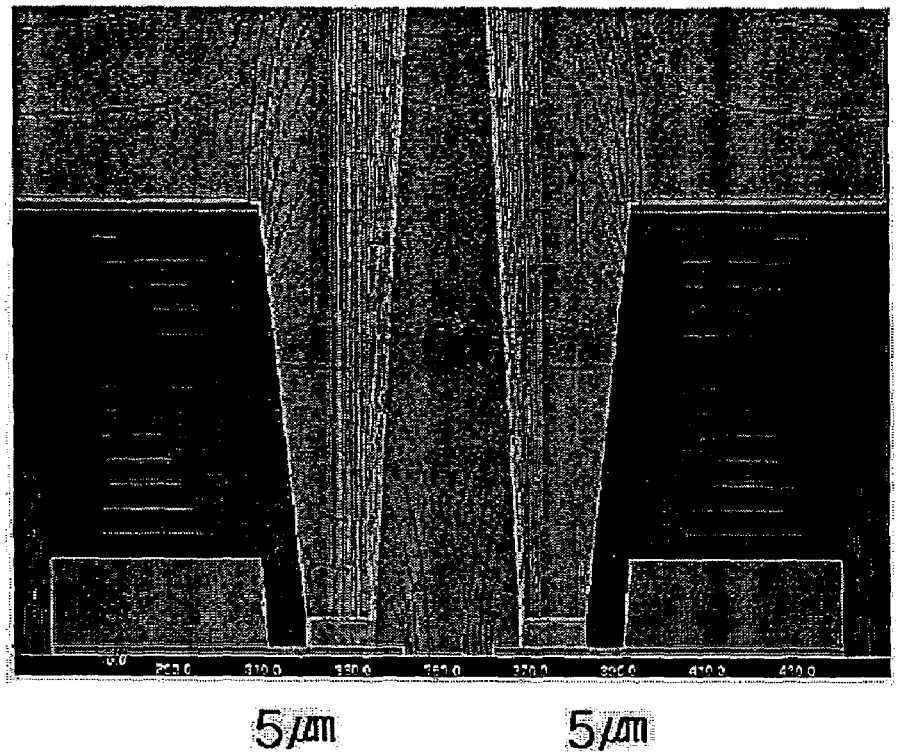
FIGS. 12A through 12C are simulation results for an electron beam emission of an FED according to an embodiment of the present invention of FIG. 3.
Figure 12B:
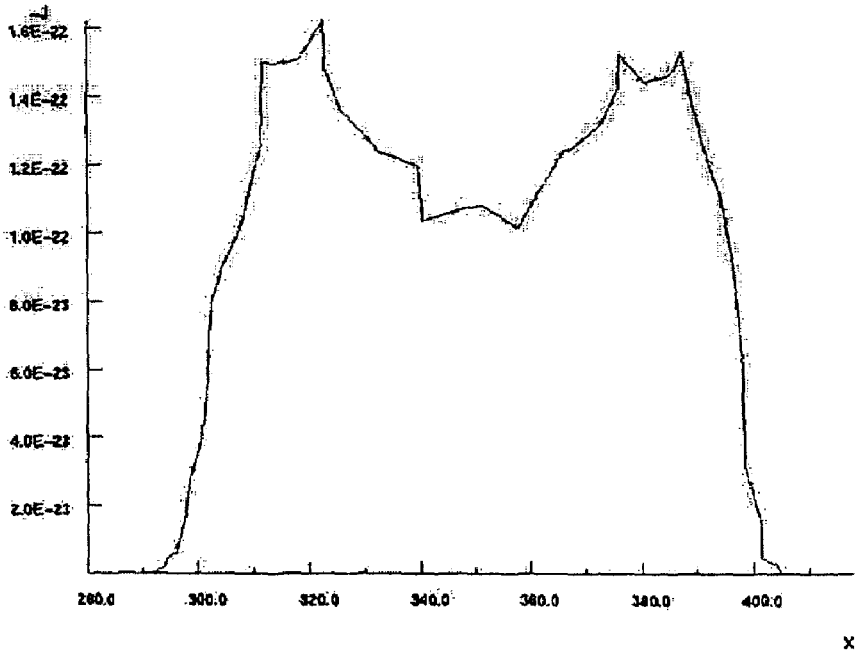
Figure 12C:
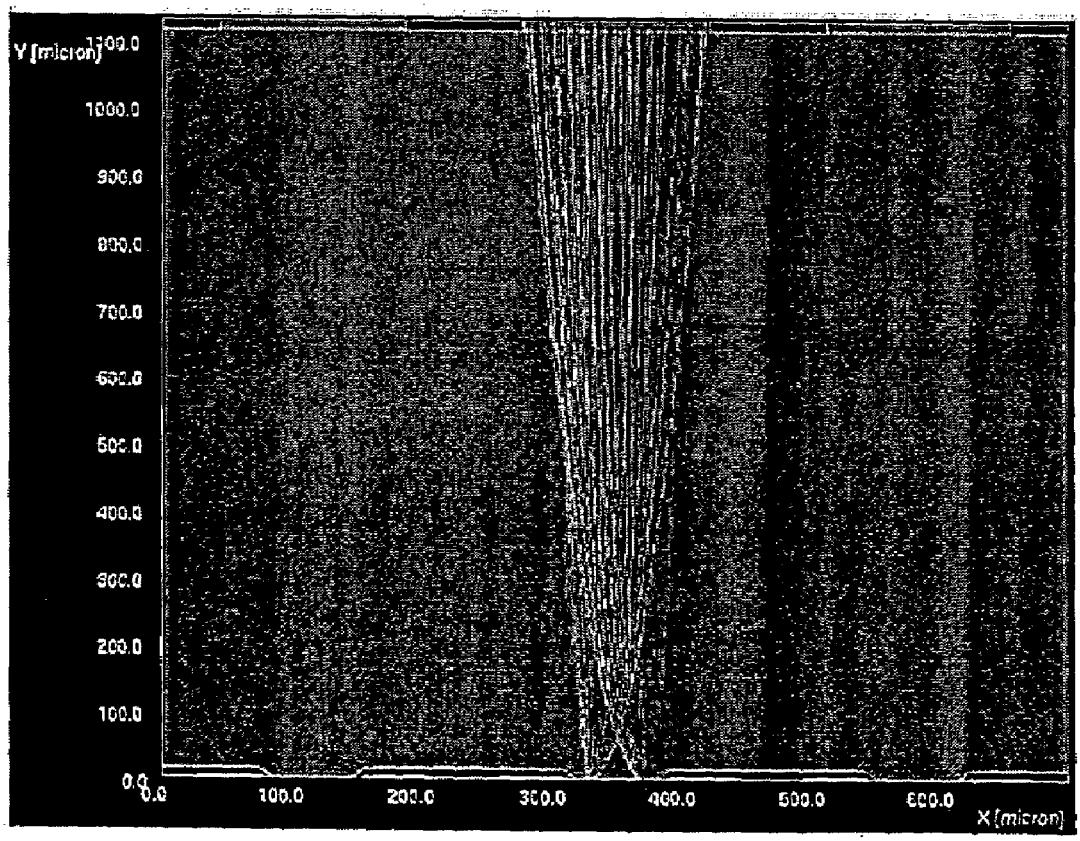

FIGS. 12A through 12C are views of simulation results for an electron beam emission of the FED according to an embodiment of the present invention of FIG. 3.

Referring to FIG. 12A, an electron beam emitted from the emitters disposed along both edges of the second opening is focused without widely diverging while proceeding toward the fluorescent layer due to the effect of electric field formed by the conductive layer. In particular, equipotential lines of the electric field are formed to surround the emitter due to the cavity formed in the cathode, and thus, the electron beam emitted from the emitter is more effectively focused.

Referring to FIG. 12B, the peak of current density corresponds to the desired pixel and the current density at the central portion of the pixel is very high.

Consequently, as illustrated in FIG. 12C, the size of a spot of the electron beam on the fluorescent layer considerably decreases compared to the comparison FED, and thus, the problem that the electron beam invades other adjacent pixels is prevented.

As described above, in the FED according to an embodiment of the present invention, the focusing characteristic of the electron beam is highly improved, the current density increases, and peak of current density is accurately located in the concerned pixel, thereby improving color purity and luminance.

Figure 13A:
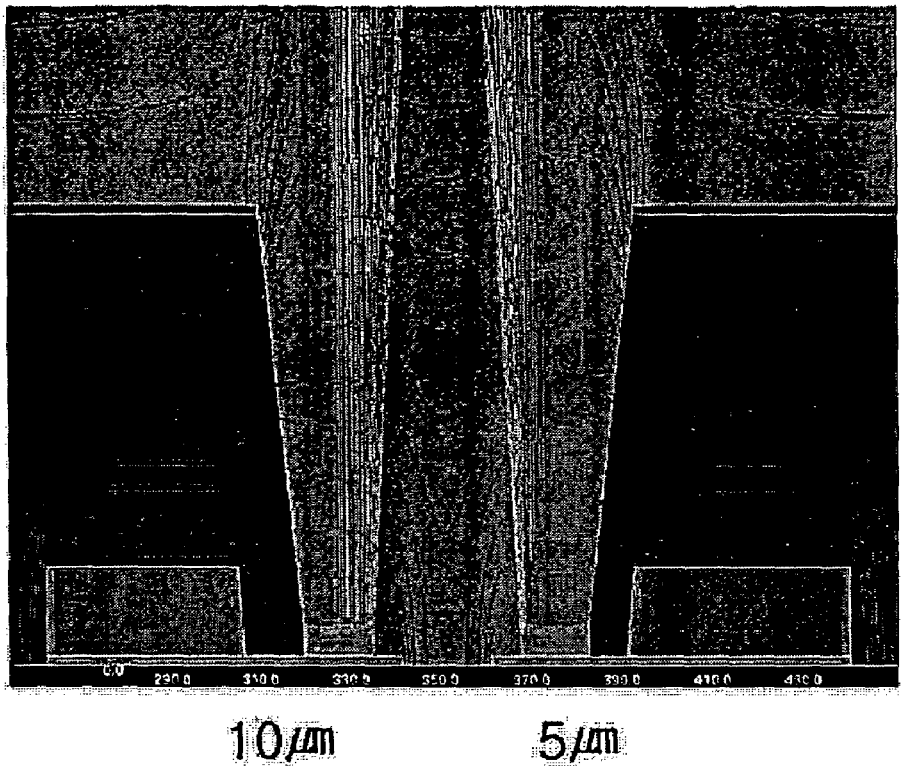
FIGS. 13A through 13C are simulation results for an electron beam emission of an FED according to an embodiment of the present invention of FIG. 3 when the distance between the conductive layer and an emitter is not uniform.
Figure 13B:
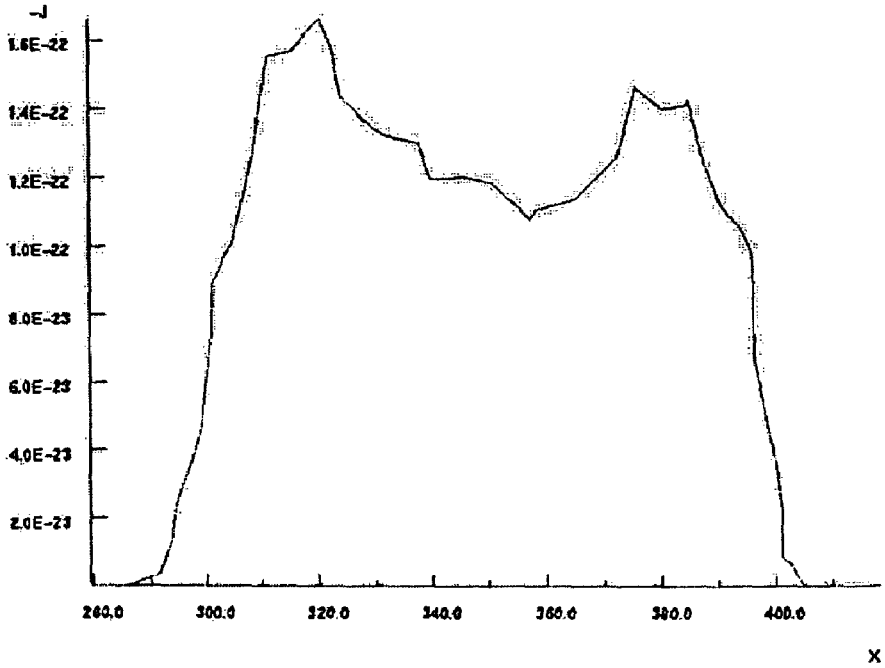
Figure 13C:
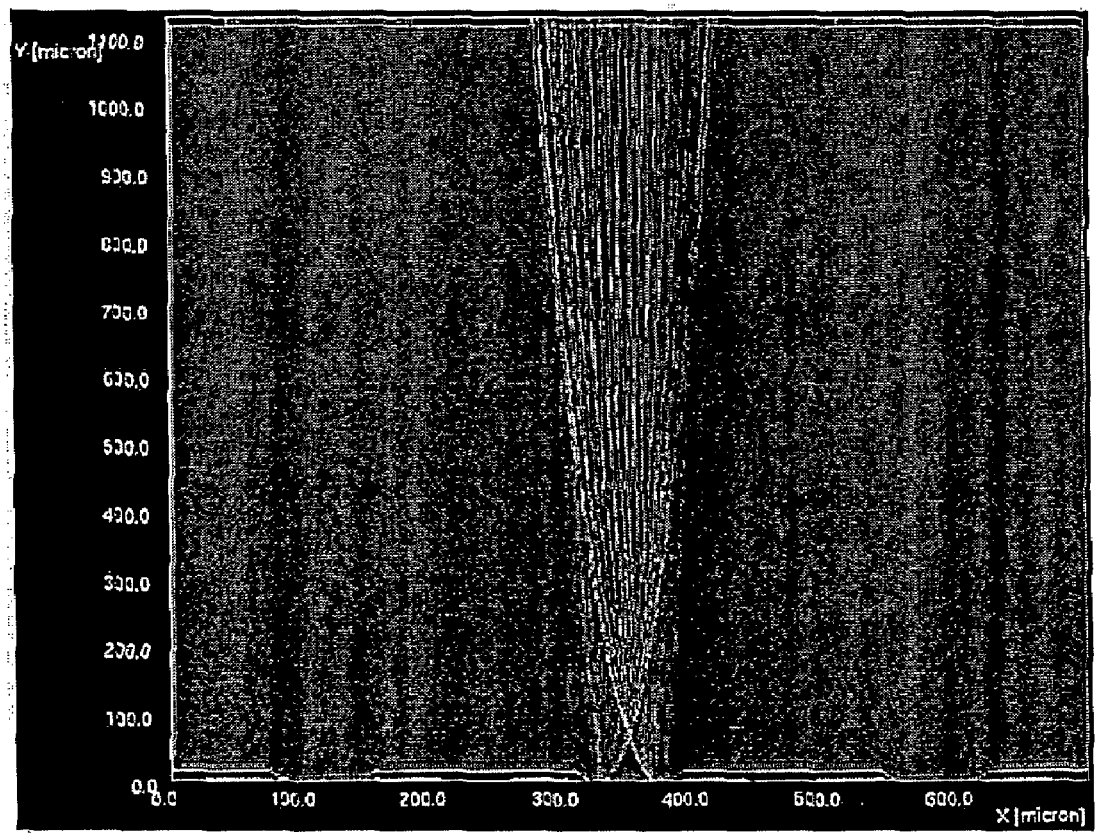

FIGS. 13A through 13C are views of simulation results for an electron beam emission of the FED according to an embodiment of the present invention of FIG. 3 when the distance between the conductive layer and the emitter is not uniform.

When manufacturing the FED, the distance between the conductive layer and the emitter may not be uniform, as illustrated in FIG. 13A, or the emitter may not accurately be located in the second opening, or an accurate arrangement may not be achieved when joining the front substrate and the rear substrate.

Nevertheless, the electron beam is effectively focused as illustrated in FIG. 13A and the peak of current density corresponds to the desired pixel as illustrated in FIG. 13B.

As a result, as illustrated in FIG. 13C, the problem of the spot of the electron beam reaching the fluorescent layer departing from the desired pixel and invading other adjacent pixels does not occur.

As described above, in the FED according to an embodiment of the present invention, the focusing of the electron beam emitted from an emitter is improved due to the flat emitter disposed along both edges of an opening and a conductive layer disposed on both outer sides of the emitter, and thus, the color purity of an image is improved, thereby obtaining a high quality image.

Also, in the FED according to an embodiment of the present invention, equipotential lines of an electric field are formed to surround an emitter due to a cavity formed in a cathode. Due to the effect of the electric field, the current density is improved, so that a luminance of an image can be improved.

Also, since a conductive layer composed of an electrically conductive paste is completely covered by an insulating layer, damage of the conductive layer due to an etchant when forming an opening in the insulating layer through etching process can be prevented.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Field Emission Display (FED) device, comprising:

a first substrate;

a cathode arranged on the first substrate:

a conductive layer arranged on the cathode, the conductive layer including a first opening;

an insulating layer arranged on the first substrate to cover surface of the conductive layer with the covered surface different from an interface imposed between the conductive layer and the cathode, the insulating layer including a second opening arranged in the first opening to expose a portion of the cathode;

a gate electrode arranged on the insulating layer, the gate electrode including a third opening connected to the second opening;

a plurality of emitters arranged on the portion of the cathode exposed in the second opening and along both edges of the second opening, the plurality of emitters being spaced apart from each other; and a second substrate facing the first substrate and spaced apart from the first substrate, the second substrate including an anode and a fluorescent layer formed on a surface thereof.

2. The FED device of claim 1, wherein the cathode includes a cavity exposing the first substrate, the cavity being arranged between the plurality of emitters.

3. The FED device of claim 2, wherein the first, second, and third openings and the cavity are square.

4. The FED device of claim 3, wherein a width of the first opening is greater than that of the second opening and a width of the cavity is less than that of the second opening.

5. The FED device of claim 4, wherein a distance between the plurality of emitters is less than the width of the second opening and is greater than the width of the cavity.

6. The FED device of claim 4, wherein a width of the third opening is equal to that of the second opening.

7. The FED device of claim 4, wherein a width of the third opening is greater than that of the second opening.

8. The FED device of claim 1, wherein the conductive layer extends in a direction of a length of the cathode along both edges of the cathode and wherein the first opening is arranged between the conductive layer on both edges of the cathode.

9. The FED device of claim 1, wherein the conductive layer is arranged on both edges of the cathode and wherein the first opening is arranged between the conductive layer on both edges of the cathode.

10. The FED device of claim 1, wherein the conductive layer is arranged on the cathode to surround the first opening.

11. The FED device of claim 1, wherein at least one of the plurality of emitters contacts a side surface of the insulating layer.

12. The FED device of claim 1, wherein the plurality of emitters comprise a carbon based material.

13. The FED device of claim 12, wherein the plurality of emitters comprise Carbon Nano-Tubes (CNTs).

14. The FED device of claim 1, wherein a plurality of the first, second, and third openings are arranged with respect to one pixel and wherein at least one of the plurality of emitters is arranged in each of the plurality of second openings.

15. A Field Emission Display (FED) device, comprising:

a first substrate;

a cathode arranged on the first substrate:

a conductive layer arranged on the cathode, the conductive layer including a first circular opening;

an insulating layer arranged on the first substrate to cover surface of the conductive layer with the covered surface different from an interface imposed between the conductive layer and the cathode, the insulating layer including a second circular opening arranged in the first circular opening to expose a portion of the cathode;

a gate electrode arranged on the insulating layer, the gate electrode including a third circular opening connected to the second circular opening;

a plurality of ring shaped emitters arranged on the portion of the cathode exposed in the second opening; and a second substrate facing the first substrate and spaced apart from the first substrate, the second substrate including an anode and a fluorescent layer formed on a surface thereof.

16. The FED device of claim 15, wherein the cathode includes a circular cavity exposing the first substrate, the circular cavity being arranged between the plurality of emitters.

17. The FED device of claim 16, wherein an inner diameter of the first opening is greater than that of the second opening and an inner diameter of the cavity is less than that of the second opening.

18. The FED device of claim 17, wherein an inner diameter of the emitter is less than that of the second opening and is greater than that of the cavity.

19. The FED device of claim 17, wherein an inner diameter of the third opening is equal to that of the second opening.

20. The FED device of claim 17, wherein an inner diameter of the third opening is greater than that of the second opening.

21. The FED device of claim 15, wherein at least one of the plurality of emitters contacts a side surface of the insulating layer.

22. The FED device of claim 15, wherein the plurality of emitters comprise a carbon based material.

23. The FED device of claim 22, wherein the plurality of emitters comprise Carbon Nano-Tubes (CNTs).

24. The FED device of claim 15, wherein a plurality of the first, second, and third openings are arranged with respect to one pixel and wherein at least one of the plurality of emitters is arranged in each of the plurality of second openings.

25. A method of manufacturing a Field Emission Display (FED) device and a Field Emission Display (FED) device made by the method, the method comprising:

forming a cathode on a substrate;

forming a conductive layer on the cathode, the conductive layer including a first opening exposing a portion of the cathode;

forming an insulating layer covering a portion of the cathode and surface of the conductive layer with the covered surface different from an interface imposed between the conductive layer and the cathode on the substrate;

forming a metallic material layer on the insulating layer, the metallic material layer including an aperture smaller than the first opening;

etching the insulating layer through the aperture to form a second opening arranged in the first opening and exposing a portion of the cathode;

patterning the metallic material layer to form a gate electrode, the gate electrode including a third opening connected to the second opening; and forming an emitter on the portion of the cathode exposed through the second opening.

26. The method and Field Emission Display device of claim 25, wherein forming the cathode comprises depositing an electrically conductive material on the substrate and then patterning it into stripes.

27. The method and Field Emission Display device of claim 25, wherein forming the cathode comprises forming a cavity in the cathode exposing the substrate.

28. The method and Field Emission Display device of claim 27, wherein the cavity is formed to be smaller than the second opening.

29. The method and Field Emission Display device of claim 25, wherein forming the conductive layer comprises coating an electrically conductive photosensitive paste on the cathode and then patterning it by exposing and developing it.

30. The method and Field Emission Display device of claim 29, wherein the electrically conductive paste is coated by screen printing.

31. The method and Field Emission Display device of claim 25, wherein forming the insulating layer comprises coating an insulating paste material on the substrate by screen printing and then sintering it.

32. The method and Field Emission Display device of claim 25, wherein forming the metallic material layer comprises depositing an electrically conductive metallic material on the insulating layer by sputtering and forming the hole by partially etching the metallic material layer.

33. The method and Field Emission Display device of claim 25, wherein etching the insulating layer comprises using the metallic material layer as an etching mask.

34. The method and Field Emission Display device of claim 25, wherein forming the gate electrode comprises patterning the metallic material layer into stripes.

35. The method and Field Emission Display device of claim 25, wherein forming the emitter comprises:

coating a Carbon Nano-Tube (CNT) photosensitive paste inside the second opening;

irradiating light behind the substrate to selectively expose to light only a portion of the CNT paste located on the cathode; and removing the remaining portion of the CNT paste not exposed to light to form the emitter of the remaining CNTs.

36. The method and Field Emission Display device of claim 35, wherein the substrate comprises a transparent glass and the cathode comprises Indium Tin Oxide (ITO).

37. The method and Field Emission Display device of claim 25, wherein forming the emitter comprises:

coating a photoresist inside the second opening and patterning it to remain only on the surface of the cathode;

coating a CNT paste inside the second opening;

heating the substrate to form the emitter by a thermochemical reaction between the photoresist and the CNT paste; and removing a portion of the CNT paste not undergoing the thermochemical reaction.

38. The method and Field Emission Display device of claim 25, wherein forming the emitter comprises:

forming a catalytic metal layer on the surface of the cathode; and vertically growing CNTs from the surface of the catalytic metal layer by supplying a carbon-containing gas to the catalytic metal layer to form the emitter.

39. The method and Field Emission Display device of claim 25, wherein the first, second, and third openings are square.

40. The method and Field Emission Display device of claim 39, wherein the emitter is formed along both edges of the second opening and is rod shaped.

41. The method and Field Emission Display device of claim 25, wherein the first, second, and the third openings are circular.

42. The method and Field Emission Display device of claim 41, wherein the emitter is ring shaped.

* * * * *